US005483548A

United States Patent [19]

Coble

[11] Patent Number: 5,483,548

[45] Date of Patent: Jan. 9, 1996

[54] INSULATED FURNACE DOOR AND WALL PANEL SYSTEM

[76] Inventor: Gary L. Coble, RD#2, Box 214, DuBois, Pa. 15801

[21] Appl. No.: 287,125

[22] Filed: Aug. 8, 1994

Related U.S. Application Data

[63] Continuation-in-part of Ser. No. 785,775, Oct. 31, 1991, Pat. No. 5,335,897, which is a continuation-in-part of Ser. No. 693,346, Apr. 30, 1991, Pat. No. 5,308,046, which is a continuation-in-part of Ser. No. 609,643, Nov. 6, 1990, Pat. No. 5,048,802, which is a continuation-in-part of Ser. No. 373,672, Jun. 28, 1989, abandoned, which is a continuation of Ser. No. 213,699, Jun. 30, 1988, abandoned, which is a continuation-in-part of Ser. No. 907,473, Sep. 15, 1986, Pat. No. 4,755,236, which is a division of Ser. No. 732,400, May 9, 1985, Pat. No. 4,611,791, which is a continuation-in-part of Ser. No. 456,823, Jan. 10, 1983, Pat. No. 4,516,758.

[51] Int. Cl.[6] ..... F27D 1/00

[52] U.S. Cl. ..... 373/75; 266/263; 266/286; 432/247

[58] Field of Search ..... 373/44, 45, 71, 373/72, 75, 76, 155, 164, 130, 137, 155, 156, 163; 266/263, 264, 283, 286; 432/247, 248, 252; 110/331, 332, 339

[56] References Cited

U.S. PATENT DOCUMENTS

| | | | |
|---|---|---|---|
| 1,733,647 | 10/1929 | Coghlan | 110/173 |
| 2,024,649 | 12/1935 | Longenecker | 110/173 |

(List continued on next page.)

FOREIGN PATENT DOCUMENTS

| | | | |
|---|---|---|---|
| 522018 | 2/1956 | Canada | 266/43 |
| 251908 | 10/1912 | Germany | 432/250 |

(List continued on next page.)

OTHER PUBLICATIONS

Babcock & Wilcox, *Saber Bloc—A High Performance Weld–on Module,* Apr. 1982, 4 page brochure, Augusta, Ga. 30903.

Johns–Manville, *Application Information Z–Blok Insulation Guide,* Jan. 1980, 20 page brochure, Denver, Colo. 80217.

Johns–Manville, *Z–Blok & Cerablanket Application Information,* Sep. 1979, 4 page brochure, Denver, Colo. 80217.

Johns–Manville, *Z–Bloc Refactory Fiber Modules For Furnace & Kiln Linings,* Sep. 1979, 4 page brochure, Denver, Colo. 80217.

(List continued on next page.)

*Primary Examiner*—Tu Hoang
*Attorney, Agent, or Firm*—David A. Burge

[57] ABSTRACT

An energy efficient wall panel for use together with other such panels to extend about selected peripheral portions of a thermal treatment chamber of a high temperature industrial furnace or the like includes a frame that supports an array of elongate cast refractory thermal insulating members 1) that extend side by side, 2) that have relatively wide flange portions that extend substantially contiguously to define a rigid, impact resistant inner surface that faces toward a thermal treatment chamber for absorbing, storing and re-radiating impingent heat energy back into the chamber, 3) that have relatively thin outer portions connected to the supporting frame, 4) that have central web portions that provide needed strength and rigidity while, at the same time, permitting only minimal conductive heat transfer therethrough, and 5) that have elongate, non-cast, fiber-type thermal insulating members compressively sandwiched between adjacent pairs of the cast refractory members for enhancing the panel's insulating capability while assisting the frame in supporting the panel's sandwiched array of insulating members. Emphasis is placed on optimally configuring the cross sections of the cast refractory members to balance the need to minimize conductive heat transfer with other requirements such as structural integrity while also providing a cast refractory inner surface that will efficiently absorb, store and re-radiate impingent heat energy.

60 Claims, 11 Drawing Sheets

U.S. PATENT DOCUMENTS

| | | | |
|---|---|---|---|
| 2,148,054 | 2/1939 | Berlek | 266/43 |
| 2,148,281 | 2/1939 | Scott, Jr. | 72/16 |
| 2,231,498 | 2/1941 | Geistler | 266/43 |
| 2,233,650 | 4/1941 | Swartz | 110/180 |
| 2,849,219 | 8/1958 | Boron | 263/40 |
| 2,998,236 | 8/1961 | Cramer et al. | 263/40 |
| 3,039,754 | 6/1962 | Jones | 263/47 |
| 3,081,074 | 3/1963 | Blackman et al. | 263/47 |
| 3,112,737 | 12/1963 | Reighart | 122/499 |
| 3,149,827 | 9/1964 | Whitten | 263/47 |
| 3,226,899 | 1/1966 | Blickle | 52/506 |
| 3,429,370 | 2/1969 | Blackman | 165/47 |
| 3,606,288 | 9/1971 | Bloom | 266/5 |
| 3,693,955 | 9/1972 | Wald et al. | 266/5 |
| 3,819,468 | 6/1974 | Sauder et al. | 161/152 |
| 3,892,396 | 7/1975 | Monaghan | 266/43 |
| 3,930,916 | 1/1976 | Shelley | 156/71 |
| 3,953,009 | 4/1976 | Kan | 266/283 |
| 3,993,237 | 11/1976 | Sauder et al. | 229/140 |
| 4,055,926 | 11/1977 | Byrd, Jr. | 52/475 |
| 4,079,184 | 3/1978 | Bahout et al. | 266/280 |
| 4,120,641 | 10/1978 | Myles | 432/3 |
| 4,194,282 | 3/1980 | Byrd, Jr. | 29/451 |
| 4,218,212 | 8/1980 | Eschenberg et al. | 432/247 |
| 4,222,337 | 9/1980 | Christiansen | 110/336 |
| 4,287,839 | 9/1981 | Severin et al. | 110/331 |
| 4,287,940 | 9/1981 | Corbett, Jr. | 165/48 |
| 4,300,882 | 11/1981 | Werych | 432/247 |
| 4,310,302 | 1/1982 | Thekdi et al. | 432/205 |
| 4,316,603 | 2/1982 | Steffen | 266/282 |
| 4,324,602 | 4/1982 | Davis et al. | 156/71 |
| 4,335,870 | 6/1982 | Diener et al. | 266/193 |
| 4,336,086 | 6/1982 | Rast | 156/71 |
| 4,366,255 | 12/1982 | Lankard | 501/95 |
| 4,367,255 | 1/1983 | Blohm | 428/99 |
| 4,423,513 | 12/1983 | De Long | 373/76 |
| 4,489,920 | 12/1984 | Jones | 266/283 |
| 4,516,758 | 5/1985 | Coble | 266/263 |
| 4,611,791 | 9/1986 | Coble | 266/263 |
| 4,647,022 | 3/1987 | Coble | 266/282 |
| 4,653,171 | 3/1987 | Coble | 29/455 |
| 4,755,236 | 7/1988 | Coble | 148/43 |
| 5,048,802 | 9/1991 | Coble | 266/263 |
| 5,308,046 | 5/1994 | Coble | 266/263 |
| 5,335,897 | 8/1994 | Coble | 266/286 |

FOREIGN PATENT DOCUMENTS

| | | | |
|---|---|---|---|
| 1106446 | 5/1961 | Germany . | |
| 1131246 | 6/1962 | Germany | 266/262 |
| 2928964 | 1/1981 | Germany . | |
| 393333 | 11/1973 | U.S.S.R. | 432/250 |
| 1490129 | 10/1977 | United Kingdom . | |
| 1571789 | 7/1980 | United Kingdom . | |
| 2095382 | 9/1982 | United Kingdom . | |
| 2096752 | 10/1982 | United Kingdom . | |
| WO8103221 | 11/1981 | WIPO | 432/233 |

OTHER PUBLICATIONS

Johns–Manville, *Cera Form Special Shapes,* Jan. 1979, 4 page brochure, Denver, Colo. 80217.

Johns–Manville, *Cera Form Boards,* Aug. 1979, 4 page brochure, Denver, Colo. 80217.

Johns–Manville, *Z–Blok Refractory Fiber Modules,* Feb. 1981, 6 page brochure, Denver, Colo. 80217.

*Iron & Steel Engineer* Magazine, Article entitled "Batch Anneal Modeling Study" by Albert R. Perrin et al, vol. 60, #6, pp. 39–45, Jun. 1983.

Lee Wilson Engineering Co., Inc., 8 page brochure entitled "Lee Wilson—Fore–Most Engineers & Mfgrs. of Annealing Furnaces . . . ", Jun. 1968, Cleveland, Ohio 44116.

Lee Wilson Engineering Co., Inc., 4 page brochure entitled "Annealing Furnace Parts", copyright 1980, Cleveland, Ohio 44116.

Wahl Refractories, Inc., 4 page Product Specification for "X–Cel Cast 60" bearing an issue date of Mar. 17, 1988, Fremont, Ohio 43420.

INSULATED FURNACE DOOR AND WALL PANEL SYSTEM

CROSS-REFERENCE TO RELATED AND RELEVANT PATENTS AND APPLICATIONS

The present application is a continuation-in-part of application Ser. No. 07/785,775 filed Oct. 31, 1991 (issued Aug. 9, 1994 as U.S. Pat. No. 5,335,897), referred to hereinafter as the "Parent Case." The Parent Case was filed as a continuation-in-part of application Ser. No. 07/693,346 filed Apr. 30, 1991 (issued May 3, 1994 as U.S. Pat. No. 5,308,046) referred to hereinafter as "The Grandparent Case." The Grandparent Case was filed as a continuation-in-part of application Ser. No. 07/609,643 filed Nov. 6, 1990 (issued Sep. 17, 1991 as U.S. Pat. No. 5,048,802) which case, in turn, was filed as a continuation-in-part of application Ser. No. 07/373,672 filed Jun. 28, 1989 (abandoned), which case, in turn, was filed as a continuation of application Ser. No. 07/213,699 filed Jun. 30, 1988 (abandoned), which, in turn, was filed as a continuation-in-part of application Ser. No. 06/907,473 filed Sep. 15, 1986 (issued Jul. 5, 1988 as U.S. Pat. No. 4,755,236), which case, in turn, was filed as a division of application Ser. No. 06/732,400 filed May 9, 1985 (issued Sep. 16,1986 as U.S. Pat. No. 4,611,791), which case, in turn, was filed as a continuation-in-part of application Ser. No. 06/456,823 filed Jan. 10, 1983 (issued May 14, 1985 as U.S. Pat. No. 4,516,758). With the exception of the "Parent Case" and the "Grand-parent Case," all of the patents and applications that are identified above will be referred to collectively hereinafter as the "Great Grandparent Cases." The disclosures of all of the Parent, Grandparent and Great Grandparent Cases are incorporated herein by reference.

Reference also is made to the following additional applications (and to patents that have issued therefrom) that are descendants of the earliest-filed of the above-listed Great Grandparent Cases. These include application Ser. No. 06/659,856 filed Oct. 11, 1984 (issued Mar. 31, 1987 as U.S. Pat. No. 4,653,171), which, in turn, was filed as a division of application Ser. No. 06/477,219 filed Mar. 21, 1983 (issued Mar. 3, 1987 as U.S. Pat. No. 4,647,022), the latter of which was filed as a continuation-in-part of said earliest-filed of the Great Grandparent Cases, namely application Ser. No. 06/456,823 filed Jan. 10, 1983 (issued May 14, 1985 as U.S. Pat. No. 4,516,758). U.S. Pat. No. 4,653,171 and 4,647,022 (and the applications from which they issued) relate to features of furnace door construction and reconstruction, and will be referred to hereinafter as the "Door Patents," the disclosures of all of which are incorporated herein by reference.

BACKGROUND OF THE INVENTION

1. Field of the Invention

The present invention relates to the provision, use, maintenance, repair and reconstruction of energy efficient wall and closure systems that employ novel and improved panel assemblies of cast refractory and other insulating and support components for extending about selected peripheral portions of a thermal treatment chamber, with each panel assembly including an array of elongate cast refractory members 1) that extend side by side, 2) that have relatively wide flange portions that extend substantially contiguously to define a rigid, impact resistant inner surface that faces toward a thermal treatment chamber for absorbing, storing and re-radiating impingent heat energy back into the chamber, 3) that have relatively thin outer portions connected to the supporting frame, 4) that have central web portions that provide needed strength and rigidity while, at the same time, permitting only minimal conductive heat transfer therethrough, and 5) that have elongate, non-cast, fiber-type thermal insulating members compressively sandwiched between adjacent pairs of the cast refractory members for enhancing the panel's insulating capability while assisting the frame in supporting the panel's sandwiched array of insulating members. To provide panel assemblies that are optimally configured to meet the needs of a particular installation, the cross sections of the cast refractory members are optimally configured to desirably balance the need to minimize conductive heat transfer from inner to outer portions with other needs such as the need to provide strength and durability, the need to prevent the escape into the treatment chamber of fibrous refractory material, and the need to provide a relatively rigid, impact resistant inner surface that will efficiently absorb, store and re-radiate impingent heat energy. Also included within the purview of the present invention are a number of example forms of panel assemblies that employ cast sandwiched arrays of cast and fibrous refractory members, with the cast refractory members having web cross sections that minimize conductive heat transfer therethrough while also suitably balancing other needs.

2. Prior Art

In industry, high temperature furnaces of a wide variety of types are used to heat quantities of material that are to be used in manufacture. A high temperature industrial furnace typically includes wall and closure structures that extend about a thermal treatment chamber, with the wall and closure structures being formed from materials that will withstand the high temperatures to which they are exposed, and that will serve an insulating function so that outer surface portions of the walls and closures are maintained at significantly lower temperatures than are the inner surface portions thereof.

In many high temperature industrial furnace installations, it is important that the materials that are chosen to form the inner surface portions of wall and closure structures be capable of storing heat energy that is impingent on the inner surface portions, and of radiating heat energy back into the associated treatment chamber. Absent this heat storage and re-radiation capability, materials being heated in the treatment chamber will not be as evenly heated as desired for such material portions as are located near peripheral portions of the treatment chamber will receive less heat energy than will more centrally located material portions because heat that is impingent on inner wall surfaces will be absorbed rather than re-radiated back toward material portions that are located near the inner wall surfaces. A term used in industry to describe the effect that non-re-radiating inner wall surfaces have on the heating of objects that are located near such wall surfaces is "shadow effect"—a term intended to suggest that material portions positioned near a non-re-radiating inner wall surface will suffer uneven heating just as if it were placed within a "shadow" that is not properly radiated by heat energy that is being supplied to the treatment chamber.

Refractory brick often has been used to form at least significant portions of the inner surface structures of walls that surround the thermal treatment chambers of high temperature furnaces. While refractory brick is strong, resists physical abuse and has a capability to store impingent heat energy and to re-radiate stored heat energy back into a thermal treatment chamber, walls formed using brick are quite heavy, tend to deteriorate over time due to exposure to high temperatures within the range of 2000 to about 3000 degrees Fahrenheit, periodically need to be repaired and/or rebuilt, and typically need to be constructed relatively thickly in view of their somewhat less-than-desirable insulating characteristics.

Castable refractory material also has been used in various pre-fabricated forms and configurations to line or form component parts of wall and closure structures for use with high temperature industrial furnaces. Depending on the character and configuration of the materials that are used to form, reinforce and mount castable refractory members, such members can exhibit good strength and impact resistance characteristics, and can provide surface portions that will store and re-radiate heat energy. And, like refractory brick, appropriately formed castable refractory members can withstand exposure to high temperatures of up to about 3000 degrees Fahrenheit for reasonable periods of service before requiring repair and/or replacement.

As an alternative to the use of such rigid materials as refractory brick and cast refractory members, refractory fiber materials in bulk, bat and blanket form also have been proposed for use in forming wall and closure components for extending about peripheral portions of the thermal treatment chambers of high temperature furnaces and the like. While refractory fiber materials tend to exhibit significantly better insulating characteristics than do such rigid materials as refractory brick and cast refractory members, fiber refractory materials perform poorly when subjected to physical abuse, and tend to have an upper temperature limit for effective performance of about 2400 degrees Fahrenheit. While fiber refractory materials can physically withstand temperatures that are higher than about 2400 degrees Fahrenheit, a significant reason why such materials tend to fail to perform properly at temperatures above about 2400 degrees Fahrenheit is that steel anchoring materials and the like that need to be used to support and retain fiber refractory material in position tend to lose their requisite anchoring effect if fiber refractory materials are subjected to temperatures that extend beyond about 2400 degrees for significant periods of time.

In an effort to address the need for wall and closure structures that will make good use of such available materials as are described above, a number of the referenced Grandparent and Great Grandparent Cases, and the referenced Door Patents propose various composite barrier system approaches that are embodied in a variety of forms of insulated furnace door panels and the like. The approach taken in proposals of the Grandparent and Great Grandparent cases, and in proposals that have been made by others, is to make use of a "composite barrier system" that utilizes various combinations of solid (typically rigid), heat-storing-and-reradiating refractory materials together with fibrous (typically flexible), non-storing-and-non-reradiating materials to provide structures that are tailored to meet the needs of specific applications.

While the approach of utilizing various forms of "composite barrier systems" is known and has been used with success to meet various needs and requirements that are encountered in specific types of installations, the approach that typically has been used is to provide very different designs with each being tailored to address specific needs of a specific installation. What has not emerged is a single approach that has widespread applicability for use in designing and providing a versatile family of "composite barrier system products" that are optimized to meet specific needs without necessarily differing a great deal in structural configuration.

Turning to a more specific example of an application wherein needs of various types arise for wall and closure structures that are intended to minimize heat loss from high temperature industrial furnaces, in the steel industry it is well known to utilize what is referred to as a "reheat furnace" to sequentially heat large, preformed bodies of steel to desired temperatures to enable the heated bodies to be "worked" or otherwise formed, typically by rolling or by forging. A reheat furnace characteristically has a treatment chamber that is capable of receiving a plurality of large steel bodies such as slabs, billets or blooms of steel. The bodies of steel to be heated typically are fed through the treatment chamber relatively slowly in a direction of travel that extends from a closure controlled inlet or entry opening located on one side of the treatment chamber to a closure controlled outlet or exit opening located on an opposite side of the treatment chamber.

In a number of the referenced cases, the approach taken is to utilize a combination of cast refractory and fibrous refractory materials to define exposed inner surface portions of insulating panels, typically insulating panels that are used in the construction of inlet and/or outlet closures. While exposed fiber-type refractory bodies that are supported by exterior frame structures are well suited to serve the needs of furnace treatment chambers that operate at or below about 2,400 degrees Fahrenheit, present-day materials from which compressible fiber-type refractory bodies are formed tend not to provide insulated panel assemblies that are characterized by long service life if directly exposed for substantial periods of time to treatment chamber temperatures that exceed about 2,400 degrees Fahrenheit.

Other concerns also arise when fibrous refractory materials are used to define exposed inner surface areas of insulating panels of reheat furnaces and the like. One such concern is that, when relatively large interior surface areas of fiber-type refractory panels are exposed for significant periods of time to high temperature environments, there is a tendency for fibers from the refractory to become airborne. As a general rule, the greater the exposed surface area of fiber-type refractory, the greater is the concern that minuscule pieces of fiber may become airborne. Furthermore, the higher the temperature to which the refractory is exposed, the more rapidly the fiber-type refractory tends to deteriorate so as to present conditions that are increasingly susceptible to tiny pieces of fiber breaking away and becoming airborne.

Another concern (that inherently is present to some degree in almost all applications wherein fiber-type refractory material is used to form exposed interior wall portions of a high temperature treatment chamber) is the "shadow effect" problem described previously. Whereas wall portions that are formed from refractory brick function quite nicely to store and re-radiate impingent heat energy, wall portions formed from fibrous refractory do not. Thus, while re-radiation of heat energy from brick-lined walls will assist in maintaining nearby portions of steel bodies at desired high temperatures, exposed inner wall portions defined by fibrous refractory tend not to desirably re-radiate heat energy (and therefore tend to permit nearby portions of uniformly heated bodies of steel to cool undesirably, just as if a "shadow" had been cast over such portions to shield them from a source of heat energy).

The "shadow effect" problem is particularly acute when it is caused by fibrous refractory that forms interior surface areas of an exit closure of a steel reheat furnace, for bodies of steel that discharge from exit openings of reheat furnaces need to be in a uniformly heated state—not a state of non-uniform heat, which tends to occur if exit closures have exposed interior surface areas that are defined by fibrous refractory material. If the "shadow effect" of fiber-type refractory causes a slab of re-heated steel to lose its uniform working temperature, the heated slab may have to be shunted aside until it can be put through still another re-heat cycle.

3. The Parent Case

The invention of the referenced Parent Case had its origin in a continuing program of research and development that also has given rise to the invention of the present case. Thus it will be understood that both the invention of the Parent case and the invention of the present case have features that address similar objectives, namely the provision of frame-supported insulated panels for use in high temperature industrial furnaces and the like wherein the insulated panels 1) alleviate "shadow effect" concerns, 2) minimize airborne fiber concerns, and 3) function well in high temperature environments, for example in steel reheat furnaces wherein temperatures are maintained within the range of about 2400 to about 3000 degrees Fahrenheit.

Whereas features of the invention of the Parent Case call for the use of cast refractory members that are of "generally T-shaped cross section" (together with bodies of fibrous refractory material sandwiched between adjacent pairs of the cast refractory members) to form frame-supported insulated panels, features of the present invention define a broader and more diversified approach that can utilize cast refractory members of a variety of cross-sectional configurations (together with fibrous refractory material sandwiched between adjacent pairs of the cast refractory members) to form frame-supported insulated panels that alleviate "shadow effect" concerns, that minimize airborne fiber concerns, and that function well in high temperature environments, for example in steel reheat furnaces wherein temperatures are maintained within the range of about 2400 to about 3000 degrees Fahrenheit.

SUMMARY OF THE INVENTION

The present invention provides an energy efficient panel for use together with other such panels to extend about selected peripheral portions of a thermal treatment chamber of a high temperature industrial furnace or the like, with the panel having an outer supporting frame that connects with outer portions of a plurality of elongate cast refractory thermal insulating members to support the members in a side-by-side array. The cast refractory members 1) have relatively wide inner flange portions that cooperate to define a substantially contiguous inner surface that faces toward the thermal treatment chamber for absorbing, storing and re-radiating impingent heat energy back into the chamber, 2) have relatively thin outer portions that couple, along spaced lines of connection, to the outer supporting frame without providing a wide conductive heat transfer path so that outer surface portions of the panel tend to remain relatively cool, and 3) have central web portions that structurally connect the inner and outer portions of the cast refractory members.

Other features of panels that embody the preferred practice of the present invention relate to the highly effective way in which components of the panels cooperatively interact. Adjacent pairs of the web portions of the cast refractory members cooperatively compressively sandwich bodies of fiber-type refractory therebetween. The sandwiched bodies of fiber-type refractory not only cooperate with the cast refractory members to maximize the panel's insulating capability, but also assist the frame of the panel in supporting the panel's sandwiched array of insulating members. The wide flange portions of the cast refractory members serve to protectively enclose the fiber-type refractory so that little, if any, of the fiber-type refractory is openly exposed to the treatment chamber.

Still another feature of preferred practice has to do with "optimizing" the cross sectional configuration of cast refractory members to appropriately balance the panel's need to minimize conductive heat transfer through the cast refractory members from the inner surface to the outer frame with other needs such as the need for strength and durability, the need to prevent the escape into the treatment chamber of fibrous refractory material, and the need to provide a relatively rigid, impact resistant inner surface that will efficiently absorb, store and re-radiate impingent heat energy.

Whereas the invention of the Parent Case provides an insulated panel that utilizes cast refractory members "of generally T-shaped cross section" to sandwich bodies of fiber-type refractory, the present invention is not limited to the use of cast refractory members that are "of generally T-shaped cross section." In accordance with the present invention, cast refractory members can feature a wide variety of cross sectional configurations so long as the cast refractory members cooperate with the compressively sandwiched bodies of fiber-type refractory to provide insulated panels that embody a desired balance of such features as are described above.

Taken into consideration by the present invention is the fact that, if one restricts the guiding principles of the invention to working with only one cast refractory cross section, this is likely to impose an unwarranted restriction that bars the invention from validly addressing an appropriate range of application requirements. For example, some applications require cast refractory members that have somewhat thicker than desired web portions to provide needed strength, rigidity, impact resistance and/or longevity of service life—in which case it is suitable to accept a somewhat greater than normal amount of conductive heat transfer through the unusually thick web portions so that a panel can be provided that meets such required parameters such as strength, rigidity, impact resistance and/or longevity of service life. Alternatively, by utilizing panel component cooperation to address panel requirements (for example, by utilizing the compressively sandwiched array of cast and non-cast refractory members to cooperatively achieve panel requirements such as strength and impact resistance), guiding principles of the present invention often can permit the use of thinner web portions than otherwise required—whereby an improved balance can be struck between the need to minimize the panel's thermal conductivity and the need to maximize other characteristics such as panel strength, impact resistance, and the like.

Wall panel features that are shared by all embodiments of the present invention reside in the use they make of cast refractory members 1) that have relatively wide, typically "flange-shaped," inner portions that cooperate to define a substantially contiguously extending inner surface that faces toward the interior of a high temperature treatment chamber for absorbing, storing and re-radiating impingent heat energy, 2) that have relatively narrow, outer mounting portions that are connected at spaced locations to an outer supporting frame, and 3) that have cross-section-optimized connecting web portions that tend to be relatively narrow and that, therefore, do not tend to provide wide conductive heat transfer paths for conductively transferring heat energy from the inner portions to the outer mounting portions. Another feature that is shared by all embodiments is the use of the connecting web portions of pairs of adjacent ones of the cast refractory members to compressively sandwich bodies of fiber-type refractory material therebetween—with the compressively sandwiched bodies of fiber-type refractory not only being shielded from the high temperature of a treatment chamber by the relatively wide inner formations (whereby the escape of refractory fibers into the treatment chamber is effectively prevented), but also extending along opposite sides of many of the cast refractory members so as to cooperatively support the cast refractory members (thereby enhancing overall panel strength, integrity, impact resistance and longevity of service life).

Features that distinguish insulated panels that embody the present invention reside in the use that is made of cast refractory members that have central web cross sections that are selected to address specific needs of various applications while still maintaining a relatively narrow profile to thereby obviate concerns about excessive heat energy being conductively transmitted from the inner portions to the outer portions of the cast refractory members. Concerns of "shadow effect" are minimized by arranging the inner portions of the cast refractory members to extend substantially contiguously in defining an inner surface that has the capability of absorbing, storing and re-radiating impingent heat energy so that the panels do not act as "heat sinks." While wall panel assemblies made with suitable present-day refractory materials typically can perform without undue deterioration in the presence of treatment chamber temperatures that may rise as high as about 2,800 degrees Fahrenheit, it is contemplated that, as improvements are made in refractory materials during years to come, insulated panels that embody features of the present invention undoubtedly will be capable of performing without undue deterioration in the presence of even higher treatment chamber temperatures.

In preferred practice, each elongate cast refractory member has its outer portion attached to a separate steel sheet. Each of the steel sheets is of elongate form and has a width that is at least as wide as is the outer portion of the cast refractory member to which the sheet is attached, but with sheet width not exceeding the width that the inner portion of the attached cast refractory member adds to the contiguously extending inner surface that is defined by the side-by-side array of cast refractory members. If desired, the width of the steel sheet that is attached to a particular cast refractory member can equal the width that the particular cast refractory member adds to the inner surface—so that, when the cast refractory members are positioned side by side to define an inner surface that will absorb, store and re-radiate impingent heat energy, the steel sheets that are connected to the outer portions of the cast refractory members will extend substantially contiguously to define a steel layer that is rigidly attached to the inner surface of an outer support framework.

When the steel sheets (each of which is connected to the outer portion of a separate cast refractory member) are attached to an outer support framework (preferably by welding), the steel sheets cooperate with the framework to define what is referred to herein as an "outer supporting frame." If the steel sheets are not of sufficient width to provide a substantially contiguously extending layer of steel, additional strips of steel preferably are installed between the steel sheets so that, taken together, the steel sheets and steel strips form a substantially contiguously extending layer of steel—which layer becomes a component part of the outer supporting frame.

In forming a wall or closure panel that embodies the preferred practice of the present invention, a first cast refractory member is mounted on a mounting surface of an outer support framework by welding its steel sheet to the outer support framework, preferably at a location extending along one edge of the mounting surface. Additional cast refractory members are attached to the mounting surface of the framework one at a time by bringing the inner portion of a next-to-be-added cast refractory member into position adjacent the inner portion of the last-added cast refractory member, with each newly added cast refractory member having its steel sheet welded in place promptly after the new cast refractory member has been properly positioned. As each new cast refractory member is added, one or more bodies of fiber-type insulation are positioned between center web portions of the new cast refractory member and the last-added cast refractory member; thus, as each new cast refractory member is added, it cooperates with the last-added cast refractory member to compressively sandwich fiber-type insulation therebetween. This one-at-a-time addition of cast refractory members is continued until a side-by-side array of cast refractory members covers the mounting surface of the outer support framework, whereby a wall or closure panel is formed that incorporates the several features that have been described above.

As will be apparent from the foregoing discussion, a number of the "product" features of the preferred practice of the present invention are embodied in an insulated door or wall panel assembly that utilizes a compressively sandwiched array of rigid cast refractory insulating members and compressible, non-cast, fiber-type refractory insulating members, with each of the adjacent pairs of the cast refractory members compressing one or more non-cast members therebetween, and with the cast refractory members being positioned so that their inner portions extend side by side, in a substantially contiguous manner to define an inner surface that will absorb, store and re-radiate impingent heat energy. A rigid outer supporting frame, typically formed from steel, overlies outer portions of the compressively sandwiched array of insulating members and is securely connected to outer portions of the cast members, whereby a rugged panel assembly is provided that is well suited for use as a component of a furnace wall or a closure that selectively permits access through a furnace wall opening to the treatment chamber.

Other "product" and "method" features of the preferred practice of the present invention reside in details of construction of the cast refractory members and the manner in which cast refractory members are secured to and supported by an outer supporting frame. Other "method" features of the preferred practice of the present invention reside in methods by which an array of side-by-side cast refractory members is assembled to form insulated panel assembly of the type described, typically for use with other such panels in forming an insulated wall or closure that extends about the perimeter of a high temperature treatment chamber.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 9:
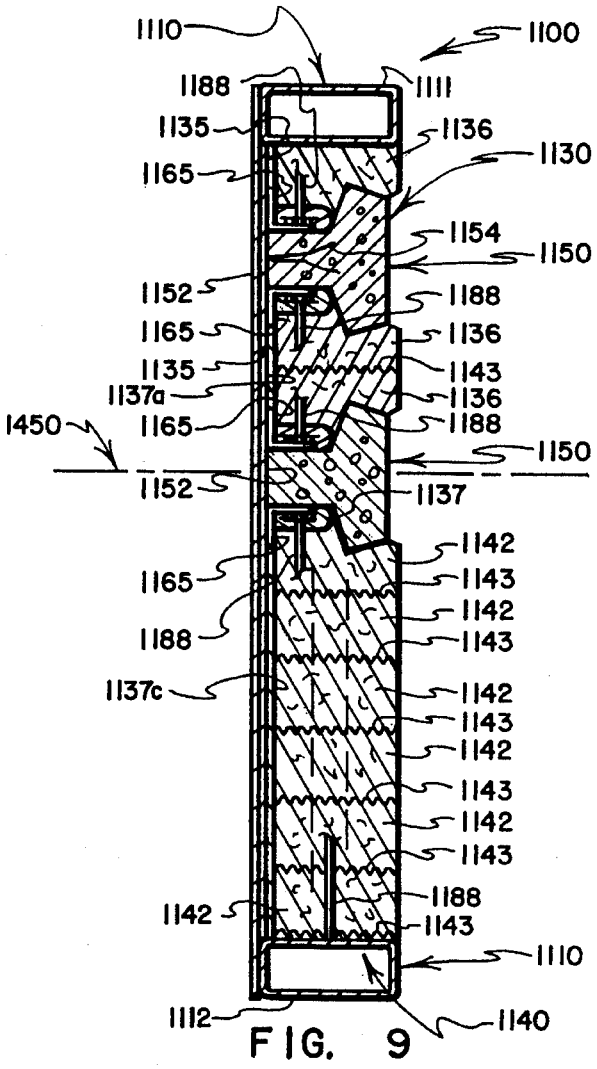
FIG. 9 is a sectional view similar to FIG. 5 but showing a second embodiment of insulated panel construction that incorporates features of preferred practice.
Figure 11:
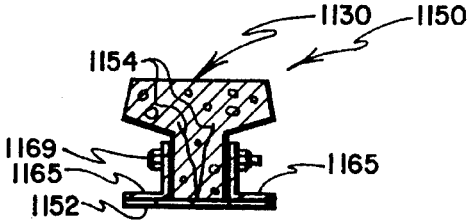
FIG. 11 is a sectional view as seen from a plane indicated by a line 11—11 in FIG. 10.
Figure 10:
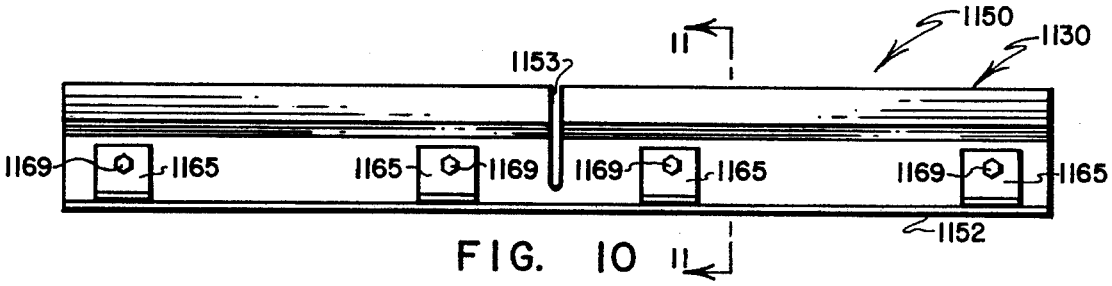
FIG. 10 is top plan view of one of the cast refractory members that is utilized in the second embodiment.
Figure 12:
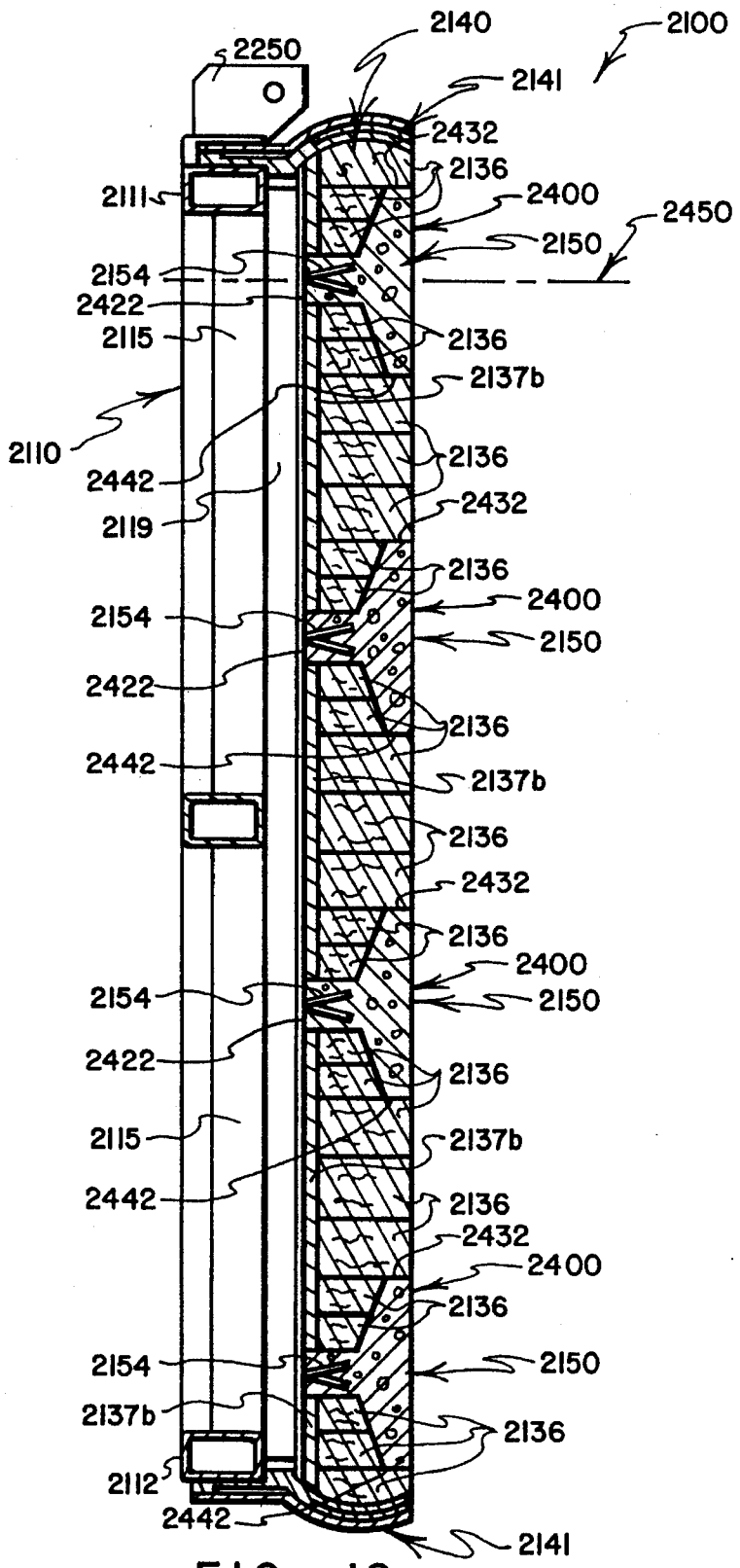
FIG. 12 is a sectional view similar to FIGS. 5 and 9 but showing a third embodiment of insulated panel construction that incorporates features of preferred practice.

Features of a plurality of insulated panel assembly embodiments are illustrated in the drawings and described below. Features of a first embodiment are depicted in FIGS. 1–8, with a first embodiment of insulated furnace door panel being indicated generally by the numeral 100 in FIGS. 1–5. Features of a second embodiment are depicted in FIGS. 9–11 with a second embodiment of insulated furnace door panel being indicated generally by the numeral 1100. Features of a third embodiment are depicted in FIG. 12, with a third embodiment of insulated furnace door panel being indicated generally by the numeral 2100.

While some features of the present invention are employed in the three embodiments that are depicted in FIGS. 1–12, it should be understood that FIGS. 1–12 (and much of the description that relates thereto) has been reproduced from the referenced Parent Case and is presented herein not only because the present invention represents a closely related extension of the subject matter of the Parent Case, but also because some features of the present invention need to be understood so that newer developments can be viewed in proper perspective. Thus it will be understood that, while some features of the present invention are included in the first, second and third embodiments that are depicted in FIGS. 1–8, 9–11 and 12, respectively, features of the best mode known to the inventor at the time of the filing hereof for carrying out the preferred practice of the present invention are incorporated in the fourth, fifth, sixth and seventh embodiments 3100, 4100, 5100, 6100 that are depicted, respectively, in FIGS. 13–14, 15–16, 17–18 and 19–20, and are described later in this document.

Because all seven of the embodiments 100, 1100, 2100, 3100, 4100, 5100 and 6100 have components and features that are substantially equivalent both in general nature and in function (i.e., they "correspond" even though the precise forms that they take may differ), "corresponding" components and features of the various embodiments are indicated by numerals that differ by a magnitude of one or more thousand. For example, corresponding components and features of the first and second embodiments 100, 1100 are indicated in FIGS. 1–8 and FIGS. 9–11, respectively, by numerals that are identical except that they differ by a magnitude of one thousand. Corresponding components and features of the first and third embodiments 100, 2100 are indicated in FIGS. 1–8 and 12, respectively, by numerals that are identical except that they differ by a magnitude of two thousand. Likewise, corresponding components of each of the fourth, fifth, sixth and seventh embodiments are indicated in FIGS. 13–14, 15–16, 17–18 and 19–20, respectively, by numerals that differ from those used with other embodiments by magnitudes of one or more thousand.

Referring to FIGS. 1–5, a first embodiment of insulated furnace door panel is indicated generally by the numeral 100. Toward the left side of FIGS. 1 and 2, right end portions of an adjacent, substantially identical insulated door panel 100' are shown, with the remainder of the door panel 100' being broken away. As those who are skilled in the art readily will understand, a set of adjacent insulated door panels (with the set including the panels 100, 100' and perhaps one or more similarly configured additional panels, not shown) can be utilized to selectively open and close an exit opening of a steel reheat furnace. While neither a steel reheat furnace nor structure defining an exit opening of such a furnace are depicted in the drawings, the referenced Door Patents (the disclosures of which are incorporated herein by reference) discuss selected features of conventional steel reheat furnaces and depict structure that defines furnace exit openings through which heated bodies of steel (typically steel slabs) are discharged or extracted. Likewise, the referenced Parent Case (the disclosure of which is incorporated herein by reference) discusses and depicts structure that extends about an inlet opening through which bodies of steel to be heated (typically steel slabs) are introduced into the treatment chamber or hearth of a steel reheat furnace.

Figure 5:
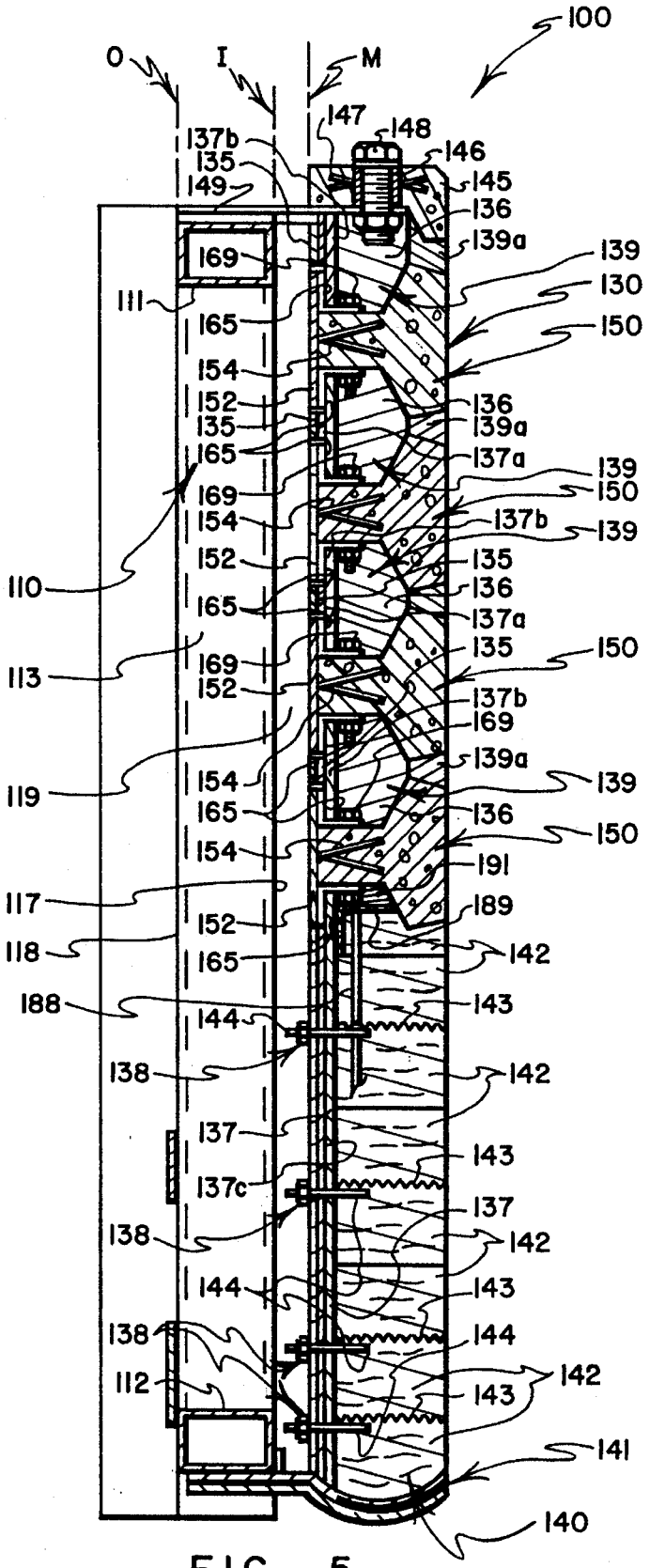
FIG. 5 is a sectional view, on an enlarged scale, as seen from a plane indicated by a line 5—5 in FIG. 2.

Referring to FIGS. 1–4 and particularly to FIG. 5, the insulated door panel 100 has an inwardly-facing surface 130 that also is referred to herein as the "interior surface 130" of the panel 100. The interior surface 130 is cooperatively defined by inwardly facing surface portions of a plurality of bodies of refractory material that comprise a "compressed stack" of refractory, indicated generally by the numeral 140. The stack 140 has a thickness (typically six or seven inches) that makes up about half of the total thickness of the insulated door panel 100.

Overlying exterior surface portions of the stack 140 is a welded steel framework 110 that also is referred to herein as the "frame 110." As will be explained in greater detail later herein, the stack 140 is securely connected to the frame 110 for movement therewith—which is another way of saying that at least selected ones of the bodies of refractory material that comprise the stack 140 are rigidly connected to the frame 110 to hold the bodies of refractory material securely in place in juxtaposition to the frame 110 so as to be movable in unison with the frame 110 to selectively open and close a treatment chamber opening of a high temperature furnace (not shown).

Figure 2:
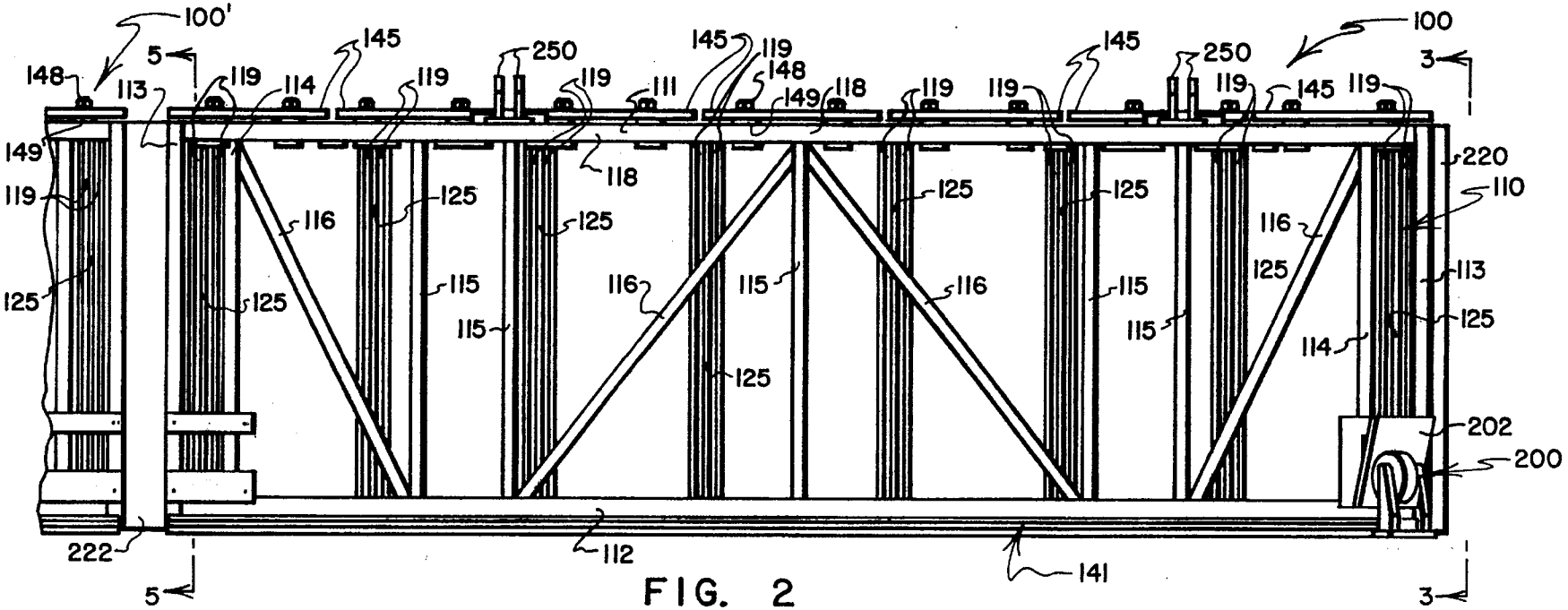
FIG. 2 is an exterior side elevational view thereof but with one of two wheeled guide assemblies removed therefrom to permit details of underlying construction to be viewed.
Figure 4:
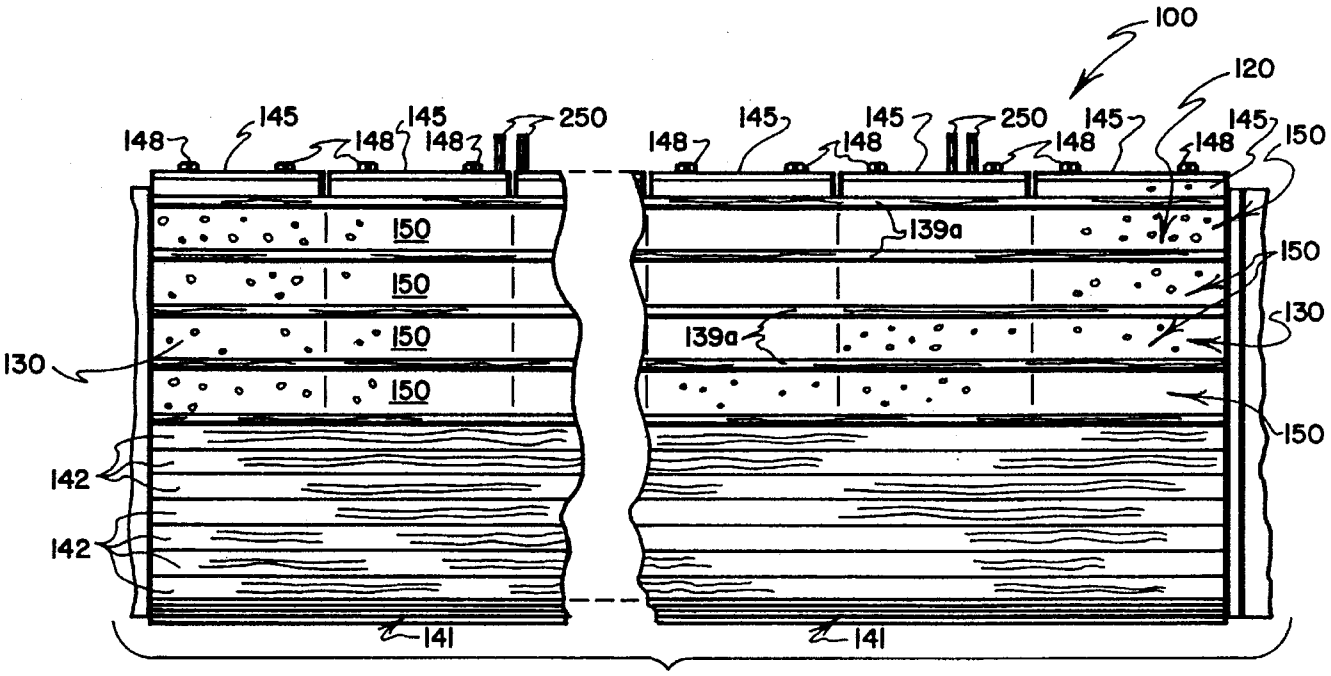
FIG. 4 is a foreshortened interior side elevational view of the first embodiment.
Figure 3:
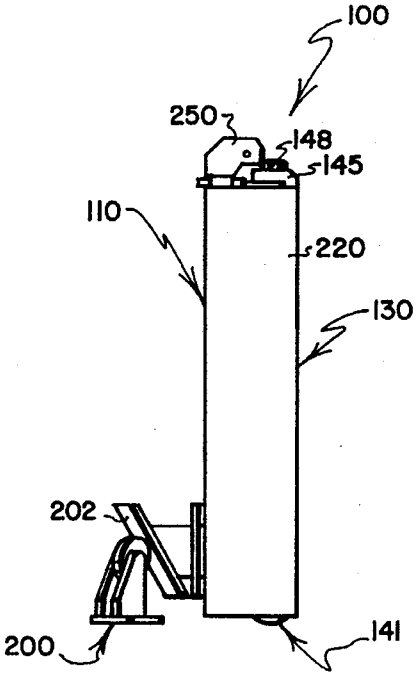
FIG. 3 is an end elevational view as seen from a plane indicated by a line 3—3 in FIG. 2.

Turning now to a more detailed description of features of the various components of the insulated furnace door panel 100, and referring initially to FIGS. 2 and 5, the frame 110 is of generally rectangular form. In the form illustrated in the drawings, the frame 110 is configured to have a width (i.e., height) of about 5 to 6 feet, and a length of about 17 to 19 feet; however, features of the invention are not limited in their applicability to use with panels having these or other specific dimensions—and, as those who are skilled in the art readily will understand, structural members can be added to or withdrawn from the frame 110 as may be needed to provide supporting frames of a wide range of sizes and shapes so that correspondingly configured insulated panels can be built. Inasmuch as the preferred practice of the present invention is not tied to the use of a frame that has elements in common with the frame 110, it is possible to substitute an entirely different frame (not shown) for the frame 110 so as to permit a different size and shape of insulated panel to be formed, for example a "cover" for what is referred to in the art as a "soaking pit," or for a ladle, etc. Thus, it will be understood that the frame 110 or other suitably configured frames can be used with each of the seven embodiments of cast refractory members 150, 1150, 2150, 3150, 4150, 5150 and 6150.

Returning to a description of features of the frame 110, structural steel members (typically including cut lengths of channel, angle iron and rectangular tube stock) preferably are welded together to form the frame 110. For example, top, bottom and end members 111, 112 and 113, respectively, (typically 5 by 3 inch rectangular tubular members that have nominal wall thicknesses of about 5/16 inch) are welded together to form a substantially rectangular perimeter of the frame 110.

Referring to FIG. 2, a pair of uprights 114 are formed from the same stock as is used to form the members 111, 112 and 113. The uprights 114 are cut to length and welded in place to rigidly interconnect the top and bottom members 111, 112 at locations that are relatively near to but are spaced from the end members 113. Still other uprights 115 typically are formed from 3 by 2 inch rectangular tube stock that has a nominal wall thickness of 3/16 inch are cut to length, and are welded in place so as to rigidly interconnect the top and bottom members 111, 112 at spaced locations between the uprights 114. Bracing members 116 typically are formed from 3 by 2 inch rectangular tube stock that has a nominal wall thickness of 3/16 inch, are miter-cut and welded in place so as to extend between the bottom member 112 and upper end regions of selected ones of the uprights 114, 115.

The members 114, 115 and 116 extend parallel to but are located between parallel inner and outer planes that are indicated in FIG. 5 by the letters "I" and "O, respectively. The planes "I" and "O" are defined by inwardly-facing and outwardly-facing surfaces 117, 118 of the frame members 111, 112 and 113. The welded assembly thus described forms a rigid, rectangular, "flat" framework that typically has a thickness of about 5 inches.

Referring to FIGS. 2 and 5, welded to the inwardly-facing surfaces 117 of at least the frame members 111, 112 and 113 (and preferably also to inwardly-facing surfaces of the bracing members 116) are paired arrays of vertically extending angle irons 119. The angle irons 119 typically are formed from stock measuring about 2 by 2 inches that has a nominal thickness of ¼ inch. The angle irons 119 are arranged in pairs that have inwardly-facing "mounting surfaces" 120 that extend in a common "mounting plane" which is indicated in FIG. 5 by the letter "M."

Referring to FIG. 5, the mounting plane M parallels the inner and outer planes I and O. Referring to FIG. 2, the angle irons 119 of each pair have spaces 125 therebetween. Typically, the spaces 125 are about ½ inch wide and are of uniform width as they extend vertically between adjacent pairs of the co-planar surfaces 120. By this arrangement, the paired angle irons 119 serve both to define flat, inwardly-facing mounting surfaces 120 (best seen in FIG. 5) to which selected refractory mountings can be welded, and to provide a plurality of spaced, vertically extending slots 125 (best seen in FIG. 2) through which threaded fasteners can be inserted to assist in coupling other refractory members to the frame 110 (as will be explained in greater detail later herein).

Before turning to a discussion of the manner in which various types of refractory members (including "cast refractory" members 150) are arranged in the stack 140 and are secured to the frame 110, a summary of what is intended by the term "cast refractory" will be presented, and reference will be made both to FIG. 7 wherein the cast refractory member 150 is depicted, and to FIG. 8 wherein a mold 170 for use in forming the refractory member 150 is somewhat schematically depicted.

What is meant herein by the use of such terms as "cast refractory," "cast-type refractory member," "refractory casting" and the like is an elongate member molded from a castable refractory material such as is sold by Wahl Refractories, Inc. of Fremont, Ohio 43420 under the trade name or trademark X-CEL CAST 60—a high density, low porosity, low cement, castable refractory substance that, after being cast, exhibits good volume stability, is quite strong when kept within a service temperature range of about 70 degrees Fahrenheit to about 3000 degrees Fahrenheit, and has good resistance to abrasion and chemical attack. The preferred castable refractory has a relatively high Alumina content (typically an $Al_2O_3$ content of about 59 percent), and typically has other oxygen compounds present therein such as $SiO_2$, CaO, $Fe_2O_3$, $TiO_3$ and MgO, with $SiO_2$ typically forming about 38 percent of the content of the refractory while other oxygen compounds together with alkalies typically form a total of about 3 percent.

The refractory preferably takes the form of a powder until mixed with a small quantity of water whereupon a viscous slurry-like mixture is formed that can be poured into a mold and vibrated to form a void-free casting. During the mixing of the refractory powder, it is preferable to add a quantity of stainless steel "needles" to the powder (i.e., typically thin, wire-like pieces of stainless steel about 1½ to 2 inches long) to serve as a form of "reinforcement" that effectively "knits" the resulting casting material together so that, if minor cracks are encountered, no actual breakage need result. Such reinforcement typically comprises about 2 to 3 percent of the refractory mixture that is used to form castings.

Figure 8:
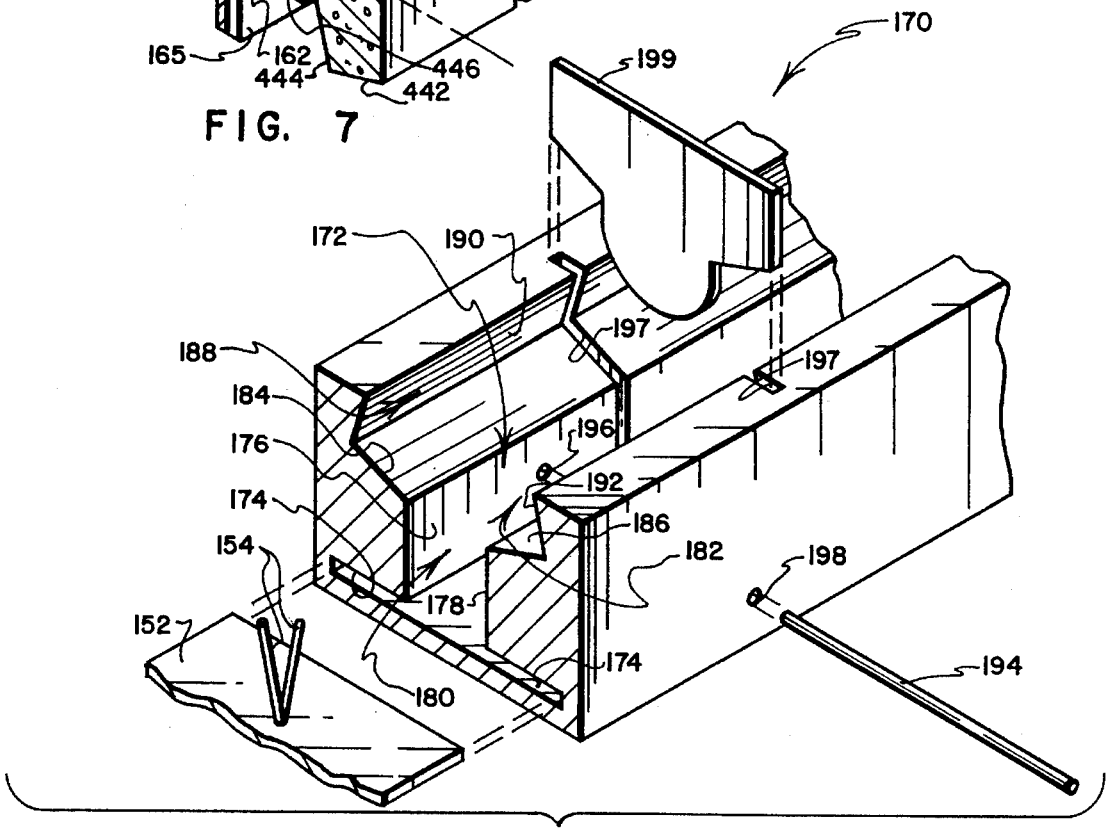
FIG. 8 is a perspective view, on substantially the same scale as FIG. 7, schematically depicting portions of a mold assembly for forming the cast refractory members of FIG. 7, with portions of a steel backing plate and steel reinforcing members welded thereto also being depicted.

Referring to FIG. 8, an elongate steel backing plate 152 that is to be joined with a casting of the refractory material described above is provided with a plurality of generally V-shaped stainless steel reinforcing wires, one of which is depicted and indicated by the numeral 154. The plate 152 is positioned at the bottom of a trough 172 that is defined centrally by the mold 170 (a slot 174 is shown in the schematic view of FIG. 8 as being configured to receive the steel backing plate 152). When so positioned, the V-shaped stainless steel reinforcing wires 154 project upwardly into central portions of the trough 172 (and thence into stem portions 162 of a cast refractory member 150 that is formed in the mold 170). The V-shaped stainless steel wires 154 extend into central parts of the stem portions 162 that are formed as castable refractory sets up between opposed surfaces 176, 178 that define a narrow bottom portion 180 of the trough 172. Located above the narrow bottom portion 180 is a tapered trough portion 182 that is bordered by opposed, inclined surfaces 184, 186 that spread progressively farther apart as they extend away from the bottom portion 180. Joining with the upper end of the tapered portion 182 is a top trough portion 188 bounded by opposed surfaces 190, 192 that are inclined slightly inwardly toward each other as they approach the open top of the trough 182.

At predetermined spaced locations along the bottom portion 180 of the trough 172, aligned holes 196, 198 open through the surfaces 176, 178, respectively, to permit wooden dowel pins 194 to be inserted therein to form bolt holes through stem portions 162 of the resulting cast refractory member 150.

At predetermined spaced locations along the trough 172, aligned groove formations 197 are formed in the opposed trough wall portions 176, 178; 184, 186; and 190, 192 for receiving cardboard dividers 199 that serve the function of forming "expansion joints" 153 (see FIG. 7) in the resulting cast refractory member 150.

The casting of refractory material atop the steel plate 152 with the wires 154 extending into the cast refractory material serves the purpose of establishing a rigid mechanical connection between the resulting cast refractory material and the steel plate 152—a bond that is strengthened when the cast refractory material is fired so as to dry, set and harden the material of the castable refractory. During the firing process the wooden dowel pins 194 are reduced to ash as are the cardboard dividers 199—whereby, what results is a hardened, tile-like impact-resistant refractory member 150 that has an enlarged formation 189 (formed by being molded between the opposed wall surfaces 184, 186 and 190, 192) located near one end region of its narrow stem 162, a steel mounting plate 152 near the opposite end region of the stem 162, and spaced bolt holes (not shown, but formed by the dowel pins 194) that extend through central portions of the narrow stem 162.

Figure 7:
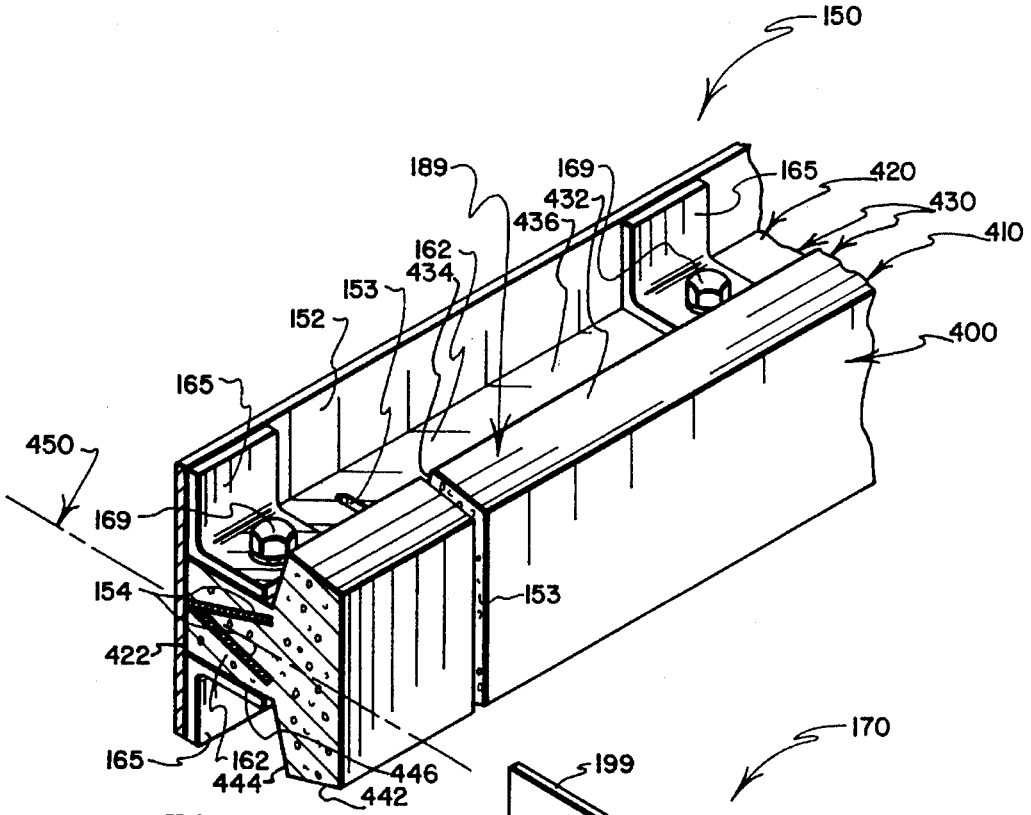
FIG. 7 is a perspective view, on an enlarged scale, showing selected central portions of one of the cast refractory members that is utilized in the first embodiment.

Referring to FIG. 7, the cross section of the cast refractory member 150 can be said to have 1) a relatively wide inner portion 410 that defines a generally flat inner surface portion 400, 2) a relatively narrow outer portion 420 (typically about half the width of the inner portion 410) that has an outer surface 422 that extends into engagement with the steel plate 152, and 3) a central web portion 430 that initially tapers so as to become slightly wider as it extends away from the flat inner surface portion 400 (see the opposed, oppositely inclined surfaces 432, 442), whereafter the central web portion tapers so as to become much more narrow (see the opposed, oppositely inclined surfaces 434, 444) until the width of the outer portion 420 is reached, whereupon the central web portion 430 does not further diminish in width as it extends toward the outer portion 420 (see the opposed, substantially parallel surfaces 436, 446).

A further feature of the cross section of the cast refractory member 150 is its symmetry about an imaginary center plane that is indicated by the numeral 450 in FIG. 7. In essence, the center plane 450 divides the refractory member 150 into "halves" that are identical except for being left and right mirror images of each other. The inner and outer surfaces 400, 422 extend substantially perpendicular to the center plane 450, and the center plane 450 substantially bisects the lengths of the inner and outer surfaces 400, 422. The opposed tapered surfaces 432, 442 are located at equal distances from and on opposite sides of the center plane 450, and are inclined at opposite but equal angles relative to the center plane 450. The opposed tapered surfaces 434, 444 are located at equal distances from and on opposite sides of the center plane 450, and are inclined at opposite but equal angles relative to the center plane 450. The opposed surfaces 436, 446 parallel the center plane 450 and are located at equal distances from and on opposite sides of the center plane 450.

Referring to FIG. 7, to complete the cast refractory assembly 150, pairs of short lengths of angle iron 165 are position along opposite sides of the stem 162, are fastened to the narrow stem by bolts 169, and are securely welded to the steel mounting plate 152. By this arrangement, the mounting plate 152 is quite rigidly connected and anchored to the cast refractory material, and the assembly 150 comprises a very rigid structure that is characterized by a substantially flat refractory surface 167 that extends substantially parallel to the plane of the mounting plate 152 but on the opposite side of the assembly 150 therefrom.

In a manner much akin to the manner in which the members 150 are formed, a specially configured set of "cap" members 145 are cast from refractory material and are anchored to inset pieces of steel to facilitate the mounting of the cap members 145 atop the frame 110. Referring to FIG. 5, the top of the stack 140 is capped by these specially configured cast refractory members 145. Just as the members 150 are formed in molds that define suitable cross-sections, the members 145 likewise are formed in suitably configured molds (not shown) and are cast in situ about steel sleeves 146 (shown only in FIG. 5) that have V-shaped stainless steel reinforcing wires 147 welded thereto. To fasten the cap members 145 in place atop the frame 110, bolts 148 extend through the sleeves 146 and through a plurality of support plates 149. The support plates 149 (best seen in FIGS. 1 and 5) are rigidly connected to the top member 111 of the frame 110 as by welding or by using suitably configured fasteners (not shown).

Figure 6:
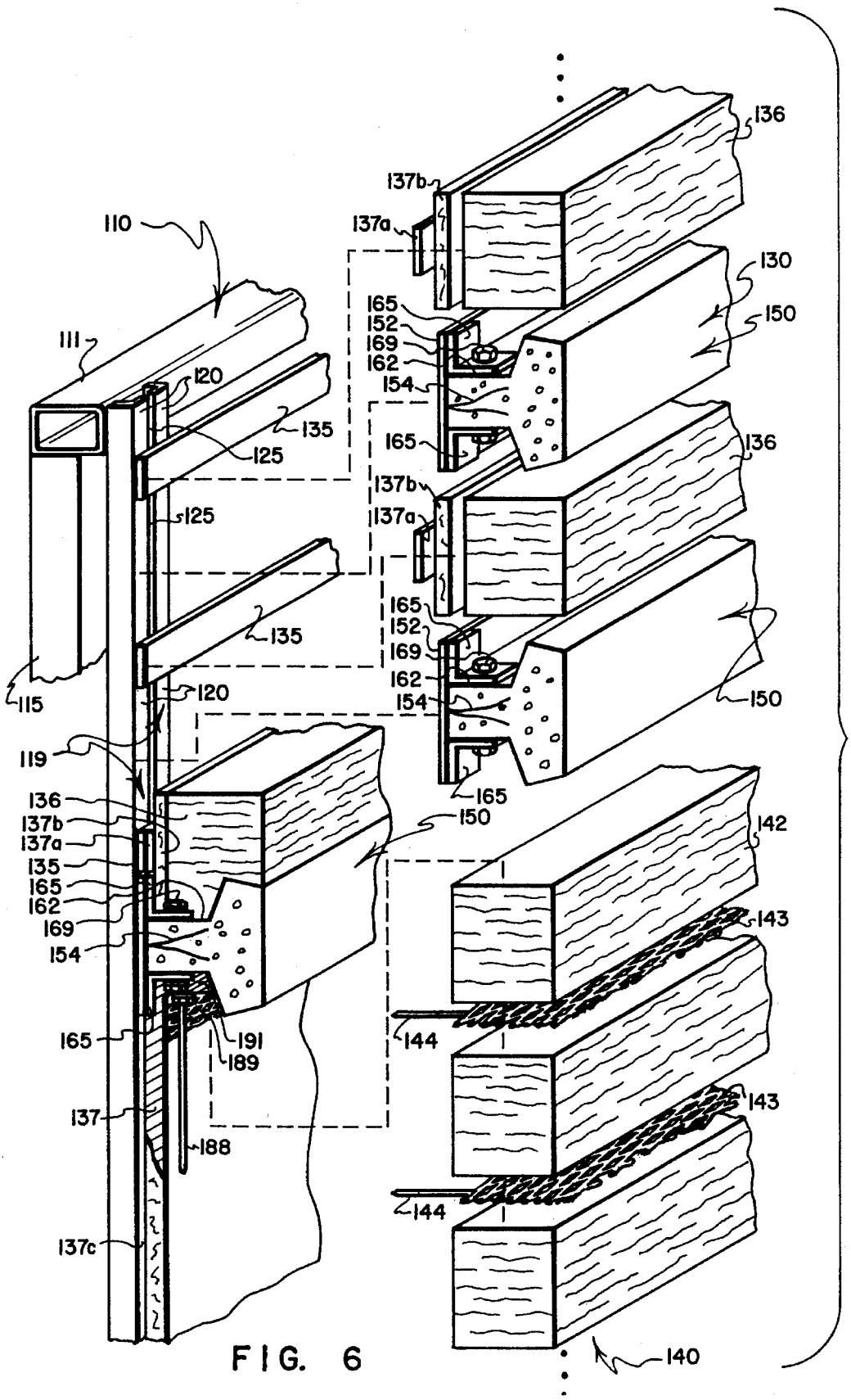
FIG. 6 is an exploded perspective view depicting selected components of the first embodiment.

Referring to FIG. 5, the bottom of the stack 140 is capped by curved plate structure 141 that clampingly engages (so as to compressively retain) a set of log-like formations 142 of fiber-type refractory that defines lower portions of the interior surface 130. Referring to FIGS. 5 and 6, it will be seen that sheets of expanded metal 143 (to which threaded rods 144 have been welded at spaced intervals) are inserted between selected ones of the log-like formations 142. A blanket of fiber-type insulation 137 and/or thin pieces of hardboard, fiber-type insulation **137*c* is/are positioned to extend along aligned exterior surface portions of the stacked array of log-like formations 142. The threaded rods 144 extend through the outer insulation 137 and/or 137***c*, through the slots 125 formed between the paired angle irons 119, and are secured by using conventional nuts and washers (indicated generally by the numeral 138 in FIG. 5).

Referring to FIG. 6, the process of assembling and connecting the various components of the stack 140 to the frame 110 is depicted somewhat schematically. The process preferably is begun by welding a spaced array of bars of steel 135 (typically steel that is about ⅛ inch to about ¼ inch thick, and about 2 inches in width) to the mounting surfaces 120 of the angle irons 119, with spaces (typically of about 8½ inches in height) being left between the bars 135 to permit the steel mounting plates 152 of the cast refractory assemblies 150 to be positioned one-at-a-time into weldable engagement with the mounting surfaces 120. The lowermost one of the cast refractory assemblies 150 is the first to be put in place with its mounting plate 152 being temporarily clamped in firm surface-to-surface engagement with each of the mounting surfaces 120 of the angle irons 119 while rigid connections are formed therebetween.

The mounting plate 152 is fastened as by welding to the angle irons 119. However, any of a wide variety of fastening techniques other than welding can be used to securely connect the lowermost and others of the cast refractory assemblies 150 to the angle irons 119. While the selection of welding as a fastening technique to connect the cast refractory assemblies 150 to the angle irons 119 may give the impression that the resulting insulated panel 100 can not be disassembled (as by removing one or more of the cast refractory assemblies 150 and/or log-like bodies of fiber-type insulation 136 that are compressively clamped between adjacent ones of the refractory assemblies, as will be described shortly), such is not the case. The welds that are formed between the mounting plates 152 and the angle irons 119 are strong and secure, but can be severed relatively easily using a cutting torch—whereby the welds that mount the cast refractory assemblies 150 on the angle irons 119 should most properly be viewed as comprising "removable" or "releasable" fastenings.

With the lowermost of the cast refractory assemblies 150 securely connected to the frame 110, other components of the stack 140 (i.e., components that are located above and below the one mounted assembly 150) are put in place. If upwardly extending components are next to be put in place, this part of the assembly process is initiated by positioning one or more log-like members 136 of fiber-type refractory atop the one frame-connected assembly 150. Also, relatively rigid panels of resin-bonded fiber-type hardboard insulation 137*a*, 137*b* are interposed between outer surfaces of the log-like members 136 and the mounting surfaces 120 of the angle irons 119. The hardboard members 137*a*, 137*b* provide relatively rigid, relatively flat "fillers" that cooperate with the assemblies 150 to define elongate "pockets" (indicated generally by the numeral 139 in FIG. 5) within which the fiber-type insulation logs 136 are "confined." The next-to-be-mounted cast refractory assemblies 150 are positioned and welded in place one-at-a-time atop underlying log-like members 136 that are duly compressed to assume their proper positions within the pockets 139. This process of properly positioning and mounting the various layers of cast refractory members 150, 145 with layers of log-like members 136 interspersed therebetween is continued until it is completed once the cap members 145 are bolted in place.

If desired, inward end regions of the "pockets" 139 (i.e., pocket-like spaces that extend between the enlarged inner end formations of the cast refractory members 150, and between the uppermost of the cast refractory members 150 and the cap member 145) may be filled with refractory mortar 139*a*. The use of refractory mortar 139*a* serves not only to close the "pockets" 139 to minimize the possibility that minuscule pieces of fiber from the logs 136 will become airborne, but also to increase the proportion of the interior surface 130 that is defined by "hard" refractory material that has a capability to store impingent heat energy and re-radiate it.

The matter of installing a compressed stack of logs of fiber-type insulation beneath the lowest of the cast refractory assemblies 150 is begun by welding a plurality of lengths of steel rod 188 (see FIG. 5 wherein one of the lengths of steel rod 188 is depicted) to the short lengths of angle iron 165 that form a part of the downwardly facing features of the lowest of the cast refractory assemblies 150. Also, to assist in holding the blanket of fiber-type insulation 137 in place near its upper end region (i.e., near its position of engagement with stem portions 162 of the lowermost of the cast refractory assemblies 150), an elongate piece of expanded metal 189 is bent so as to be of generally L-shaped cross-section (best seen in FIG. 5), and the L-shaped expanded metal member 189 is welded to each of the rods 188 that extends through selected ones of its openings at spaced locations extending along the underside of the lowermost of the cast refractory members 150 so as to clamp upper end portions of the blanket 137 against the underside of the stem 162 of said lowermost of the members 150.

Thus, when extensions of the interior surface 130 are to be provided (typically in regions extending below the area where the array of cast refractory members 150 is located) to enable a particular furnace door construction to accommodate and close a particular door opening, it will be understood that the exterior surface(s) of such extended portions of the stack 140 preferably are defined by at least one layer of thin, resin-bonded "hardboard" that contains fiber-type insulation 137*c* and/or by a blanket of fiber-type insulation 137 that is/are positioned to extend along and in engagement with the mounting surfaces 120 of the angle irons 119; and an upper end region 191 of the blanket 137 is turned inwardly to underlie and clampingly engage the stem 162 of the lowermost of the mounted refractory members 150. Log-like bodies of fiber-type insulation 142 then are positioned one at a time so as to be pierced by the rods 188 and/or so as to be clamped between elongate sheets of expanded metal 143 that have outwardly extending threaded rods 144 welded thereto, with the rods 144 extending through the slots 125, as has been described.

Once the several log-like bottom members of fiber-type insulation 142 are in place, the bottom structure 141 is positioned beneath the bottom of the stack 140 and is forced upwardly such that the log-like members 142 are substantially uniformly compressed. When the bottom structure 141 is in proper position to clampingly compress the log-like members 142 and to thereby cooperate with the expanded metal members 143 to securely retain the log-like members 142 in position, the bottom structure 141 is securely connected to the frame 110 as by welding and/or by using threaded fasteners (not shown); and, washers and nuts (indicated generally by the numeral 138 in FIG. 5) are installed on the threaded rods 144 so that the expanded metal plates 143 are firmly secured in position.

Figure 1:
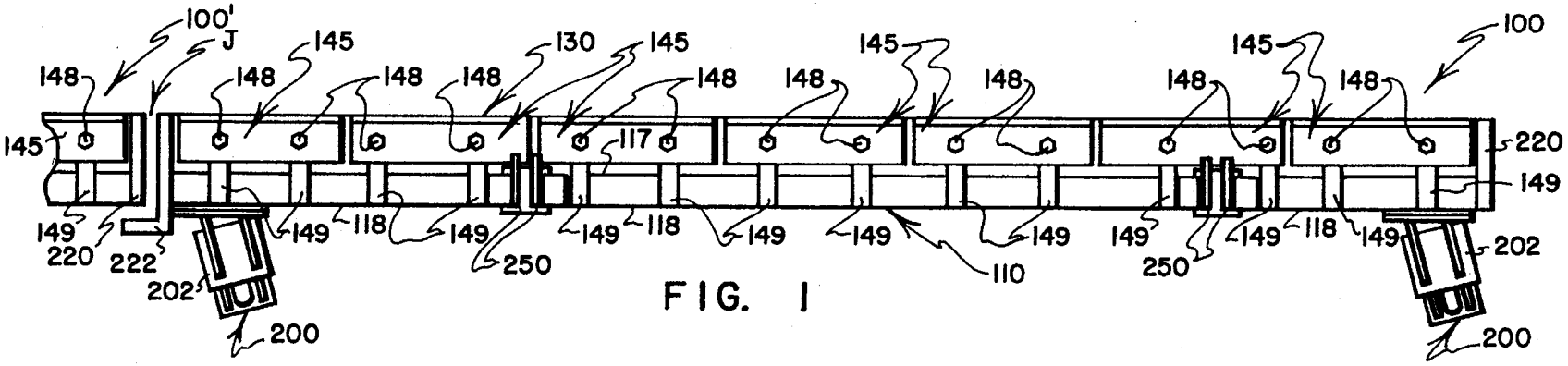
FIG. 1 is a top plan view of a first embodiment of insulated panel that includes features of the preferred practice of the present invention, with the view also showing an end portion of an adjacent, similarly configured insulated panel.

Depending on the character of the use to which a particular insulated panel is put, one or more optional structures may desirably be connected to the frame 110. Referring to FIGS. 1 and 2, if the door panel 100 is to assist an adjacent but relatively leftwardly located door panel 100' to close a furnace opening, it is desirable that, when the door panel 100' reaches its fully closed position, it sealingly engages the right end region of the adjacent panel 100'. To assist with this, wheeled assemblies 200 may be secured to such structure (not shown) as resides adjacent the lower end of the panel 100 when the panel 100 is in its closed position (illustrated in FIGS. 1–3) for engaging one or more bi-directionally inclined plates 202 that are bracket-mounted on the frame 110. By this arrangement, the insulated panel 100 can be urged to move slightly leftwardly (as viewed in FIGS. 1 and 2) so as to more closely seal a line of juncture (indicated by the letter "J" in FIG. 1) that exists between adjacent end regions of the panels 100, 100'. Also, suitably configured refractory insulation panels 220, 222 may be added to one or more of the opposed end regions of the insulated panels 100, 100' to assist in preventing the loss of heat energy from between adjacent end regions of the panels 100, 100' when the panels 100, 100' are in their closed positions.

Still another panel feature that usually needs to be provided in one form or another is a means of connecting the panel with conventional furnace structure that serves to movably position the panel. While such means are well known and form no part of the present invention, reference is made to FIGS. 1–4 wherein two pairs of upstanding arms 250 are shown connected to the top frame member 111 for facilitating the connection of the first panel embodiment 100 to conventional panel positioning apparatus (not shown). The third panel embodiment 2100 shown in FIG. 12 has similar formations 2250 for such purposes. While no such formations are shown in FIGS. 8–10 that are devoted to the second panel embodiment, those who are skilled in the art readily will understand that such formations can be added to the panel 1100.

Referring briefly to FIG. 9, a second insulated panel embodiment is indicated generally by the numeral 1100, with corresponding features and components of the first and second panel embodiments 100, 1100 being indicated by identical numerals except that they differ by a magnitude of one thousand. The panel 1100 incorporates two cast refractory members 1150 that have cross sections that are, for all practical purposes, substantially the same as the cross section of the cast refractory member 150. In FIG. 9, an imaginary center plane 1450 is shown extending centrally through one of the cast refractory members 1150, dividing the cross section of the cast refractory member 1450 into two "halves" that are identical except that they are left and right mirror images of each other.

Instead of mounting the cast refractory members "inwardly" with respect to an exterior frame structure (as has been described in conjunction with the panel 100 and its frame 110), the cast refractory members 1150 are essentially "housed within" and protectively surrounded by a perimetrically extending frame structure 1100.

Referring briefly to FIG. 12, a third insulated panel embodiment is indicated generally by the numeral 2100, with corresponding features and components of the first and third panel embodiments 100, 2100 being indicated by identical numerals except that they differ by a magnitude of two thousand. The panel 2100 incorporates a total of four cast refractory members 2150 that are spaced across the width of the panel 210, with each adjacent pair of the cast refractory members 2150 being separated by a plurality of log-like bodies 2136 of fiber-type refractory insulation. Like the panel 100, the panel 2100 utilizes an exteriorly positioned supporting frame 2110, and positions its compressed stack 2140 of refractory insulation inwardly relative to the location of the frame 2110.

The cast refractory members 2150 utilized in the third panel embodiment 2100 differ from the cast refractory members 150 and 1150 principally in that 1) their outer surfaces 2422 are only about one fourth as wide as are their inner surfaces 2400, and opposite ends of the inner surface 2400 are joined by opposed web surfaces 2432, 2442 that extend parallel to (rather than being oppositely inclined with respect to) an imaginary center plane (see the center plane indicated by the numeral 2450 in FIG. 12).

The present invention was developed as an extension of a continuing program of research that resulted in the developments that form the subjects matter of the several cases that are referenced at the beginning of the present case. In particular, the present invention represents an extension of the subject matter of the referenced Parent Case wherein the use of the T-shaped cast refractory members 150, 1150, 2150 also is described. While cast refractory members of generally T-shaped cross section (e.g., the members 150, 1150, 2150 described above) can be utilized in carrying out the preferred practice of the present invention, so can cast refractory members that have cross sections that differ from the cross sections of the refractory members 150, 1150, 2150.

Figure 13:
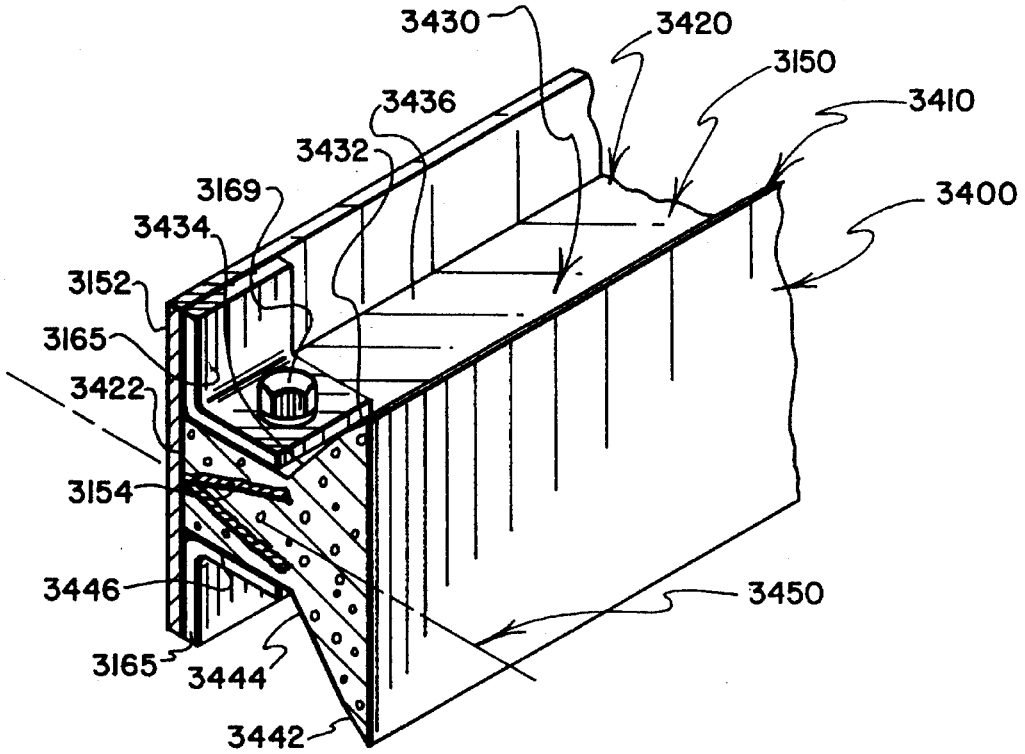
FIG. 13 is a perspective view similar to FIG. 7 but showing selected central portions of a cast refractory member that is utilized in a fourth embodiment of the invention.
Figure 14:
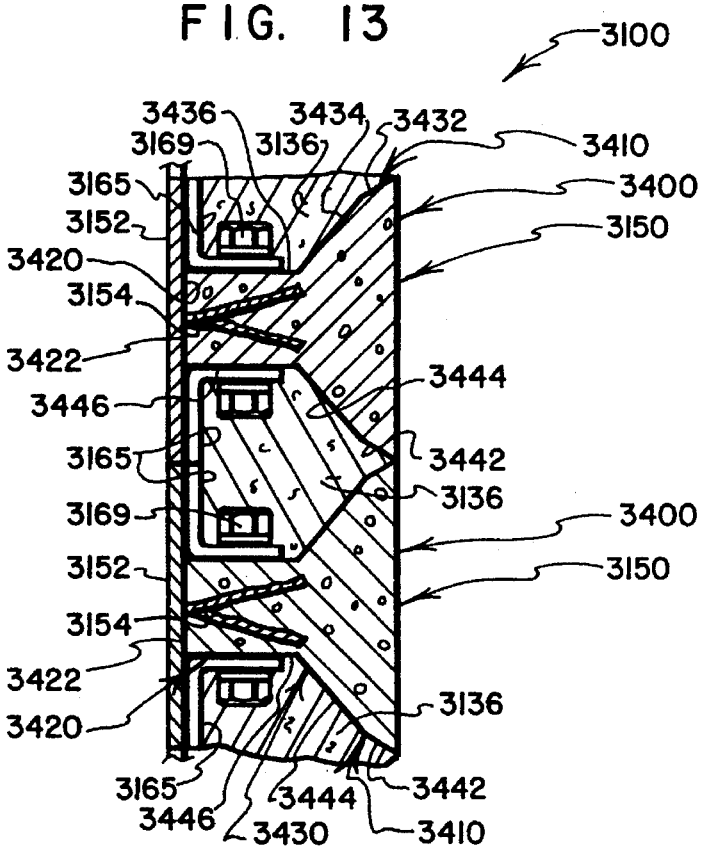
FIG. 14 is a sectional view similar to FIGS. 5, 9 and 12, but showing fourth embodiment features as utilized in an insulated panel.

Referring, for example, to FIGS. 13 and 14, the cast refractory member 3150 has an inner portion 3410 that defines a generally flat inner surface portion 3400, has an outer portion 3420 that, at its extreme outer end defines an outer surface 3422 (that typically is less than half as wide as is the inner surface portion 3400) that extends into engagement with and is connected to a steel plate 3152, and has a central web portion 3430 that tapers as it extends away from the flat inner surface portion 3400 (see the relatively short oppositely inclined surfaces 3432, 3442, and the relatively longer oppositely inclined surfaces 3434, 3444) until the width of the outer portion 3420 is achieved (see the opposed parallel surfaces 3436, 3446), whereupon the central web portion 3430 does not further diminish in width as it extends toward the outer surface 3422. Fiber-type refractory members 3136 are compressively sandwiched between adjacent pairs of the central web portions 3430 when the panel 3100 is assembled.

Because the steel plate 3152 has a width that substantially equals the width of the inner surface portion 3400, when identical cast refractory members 3150 are positioned side by side, as is depicted in FIG. 14, the steel plates 3152 abut so as to extend substantially contiguously in defining a layer of steel that preferably is welded to a supporting frame (not shown), for example, in the manner that the plates 152 of the first panel embodiment 100 are welded to the frame 110.

While the cast refractory members 150 of the first panel embodiment 100 are positioned side by side (see the panel cross section presented in FIG. 5), the oppositely inclined surfaces 432, 442 (see FIG. 7) of the cast refractory members 150 leave somewhat larger than desired gaps between the inner surface portions 400 when the refractory members 150 are installed adjacent each other, as is depicted in FIG. 5. While using refractory mortar **139*a* is the preferred approach to take if any form of significant gap is found to exist between inner portions of adjacently installed pairs of cast refractory members, it is preferred that such gaps not be as wide as those that result with use of the cast refractory members 150**, for the less refractory mortar that needs to be used, the better.

Thus, while it clearly is within the contemplation of the present invention to utilize refractory mortar to fill unwanted gaps between adjacent pairs of refractory members (for example, the mortar 139*a* that is depicted as filling gaps between inner portions of the cast refractory members 150), it is preferred that gaps between inner portions of adjacent pairs of cast refractory members be kept to a minimum so that little, if any, refractory mortar will need to be used to enable the resulting inner surface of a panel to extend substantially contiguously (i.e., substantially without interruption), and to ensure that fibers from fiber-type refractory members that are compressively sandwiched between webs of adjacent pairs of cast refractory members do not escape through wide cracks between inner portions of adjacent pairs of the cast refractory members.

Because cast refractory members (such as the members 2150 depicted in FIG. 12; the members 3150 depicted in FIGS. 13 and 14; the members 4150 depicted in FIGS. 15 and 16; the members 5150 depicted in FIGS. 17 and 18; or even non-symmetrically configured refractory members such as the members 6150 depicted in FIGS. 19 and 20) preferably are installed with minimal gaps between adjacent pairs of their inner portions (so that little if any refractory mortar needs to be used to fill such gaps), in FIGS. 13–20, the refractory members 3150, 4150, 5150, 6150 are depicted as being installed with no refractory mortar in the very narrow gaps that exist between their inner portions 3410, 4410, 5410, 6410, respectively.

While the cast refractory members 2150 of the third panel embodiment 2100 are not shown positioned adjacent each other (see the panel cross section presented in FIG. 12), but rather are shown as being relatively widely spaced apart, in preferred practice, the refractory members 2150 are positioned closely side by side (in the manner that the refractory members 150 are positioned, as shown in FIG. 5) to define pockets that extend between the webs of adjacent pairs of the refractory members so that fiber-type refractory insulation can be compressively sandwiched within these pockets, and so that fiber-type insulation will not be exposed at the inner face of the resulting panel.

Figure 15:
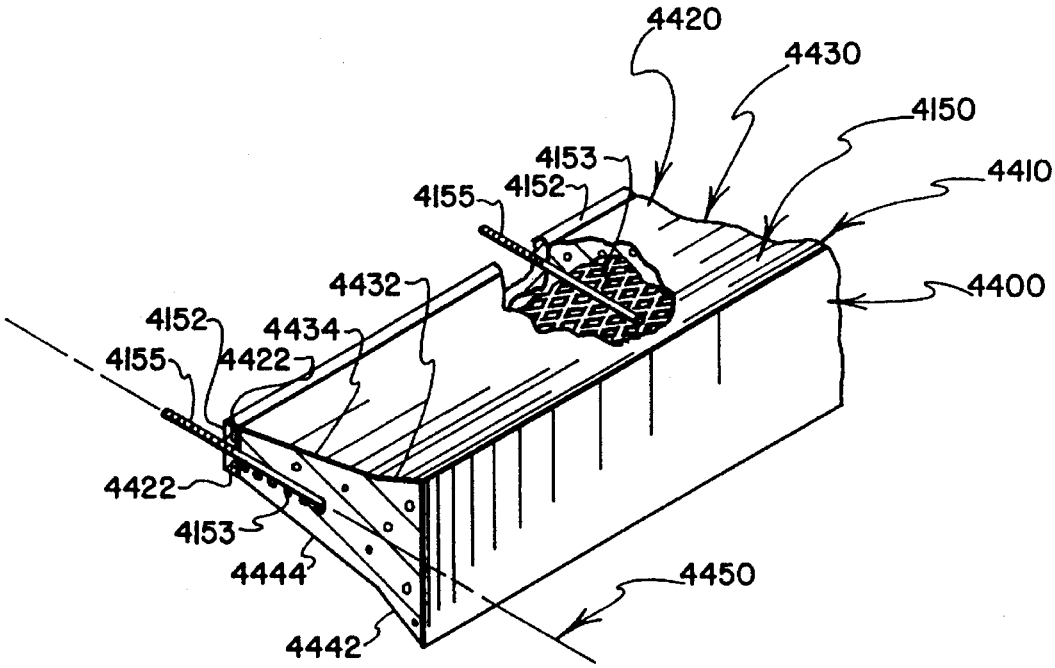
FIG. 15 is a perspective view similar to FIG. 13 but showing selected central portions of a cast refractory member that utilized in a fifth embodiment of the invention.
Figure 16:
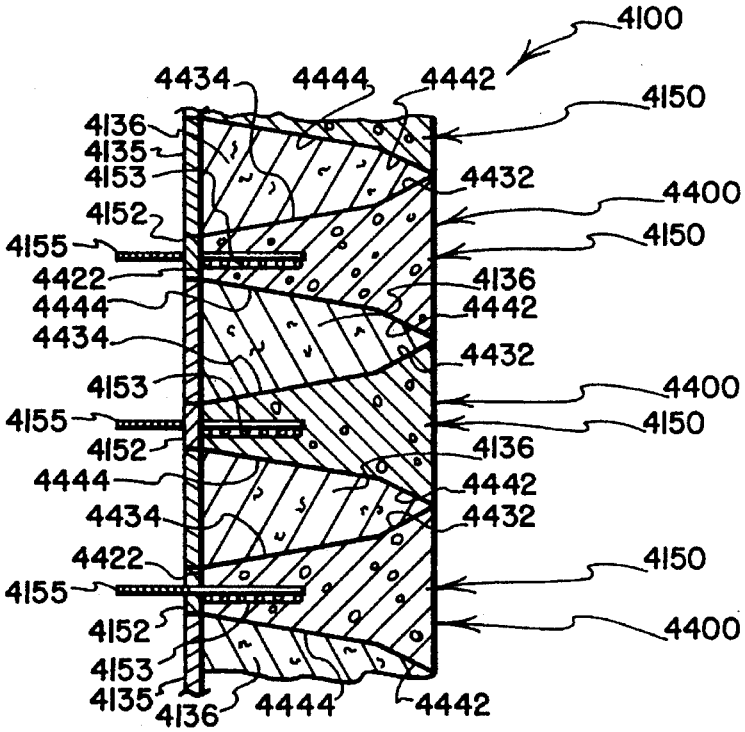
FIG. 16 is a sectional view similar to FIG. 14 but showing fifth embodiment features as utilized in an insulated panel.

To further illustrate the preferred practice of the present invention, reference is made to FIGS. 15 and 16 wherein a cast refractory member 4150 is depicted. The cast refractory member 4150 has an inner portion 4410 that defines a generally flat inner surface portion 4400, has an outer portion 4420 (that typically is less than one fourth as wide as is the inner surface portion 4400) that extends into engagement with and is connected to a relatively narrow steel plate 4152, and has a central web portion 4430 that maintains a relatively wide width as it extends away from the flat inner surface portion 4400 (see the relatively short, opposed, oppositely inclined surfaces 4432, 4442 and the relatively longer, opposed, oppositely inclined surfaces 4434, 4444 that extend the remainder of the way to the outer surface 4422). Fiber-type refractory members 4136 are compressively sandwiched between adjacent pairs of the central web portions 4430 when the panel 4100 is assembled.

Because the steel plate 4152 that is connected to the outer portion 4420 of the cast refractory member 4150 is only of a width equal to that of the outer surface 4422, when identical cast refractory members 4150 are positioned side by side (as is depicted in FIG. 16) with their inner surface portions 4400 extending substantially contiguously, as is depicted in FIG. 16, steel strips or bars 4135 need to be inserted between the steel plates 4152 that are connected to the cast refractory members 4150 so that the steel plates 4152 and strips 4135 can define a steel layer that extends substantially without interruption when the plates and strips are mounted on a mounting surface of a suitable frame (not shown), such as the mounting surface 120 of the frame 110.

To aid in mounting the cast refractory members 4150, reinforcement such as expanded metal 4153 extends into the central web portions 4430 (the cast refractory members 4150 are mold-formed about the expanded metal reinforcement 4153 when the cast refractory members 4150 are mold-formed in the manner that has been described in conjunction with the forming of the cast refractory members 150). Threaded metal rods 4155 connect with the expanded metal reinforcement 4153, extend through holes formed in the steel plates 4152, and provide threaded outer end regions that can be secured to a suitably configured frame (not shown).

Figure 17:
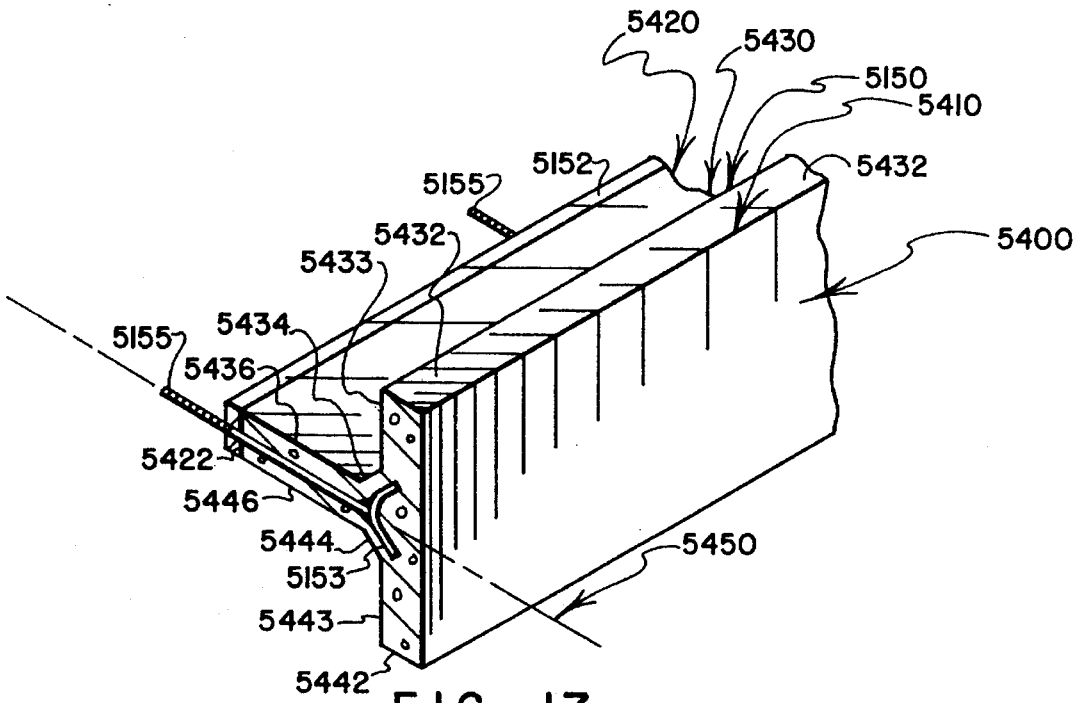
FIG. 17 is a perspective view similar to FIGS. 13 and 15 but showing selected central portions of a cast refractory member that is utilized in a sixth embodiment of the invention.
Figure 18:
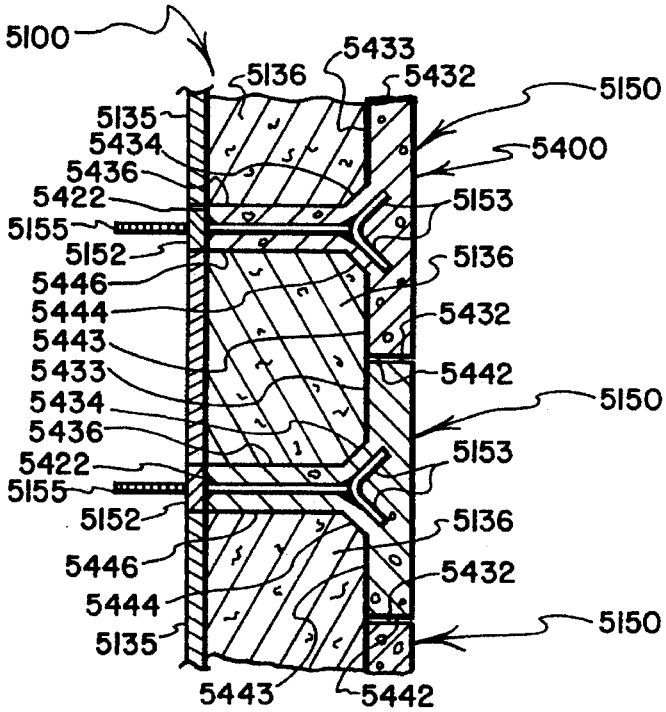
FIG. 18 is a sectional view similar to FIGS. 14 and 16 but showing sixth embodiment features as utilized in an insulated panel.

Still another cast refractory cross section is depicted in FIGS. 17 and 18 where the cast refractory member 5160 is depicted as having an inner portion 5410 that defines a generally flat inner surface portion 5400, has an outer portion 5420 (that typically is less than a half as wide as is the inner surface portion 5400) that extends into engagement with and is connected to a relatively narrow steel plate 5152, and has a central web portion 5430 that maintains a relatively wide width as it extends away from the flat inner surface portion 5400 (see the opposed, parallel extending surfaces 5432, 5442). The opposed surfaces 5432, 5442 are joined by transversely extending surfaces 5433, 5443 that cause the width of the central web portion 5430 to rapidly diminish. A pair of oppositely inclined surfaces 5434, 5444 join the transversely extending surfaces 5433, 5443 and continue to diminish the width of the central web portion 5430 until the width of the outer surface 5422 of the cast refractory member 5150 is reached, whereupon the width of the central web portion 5430 does not further diminish as the web extends toward the outer surface 5422. Fiber-type refractory members 5136 are compressively sandwiched between adjacent pairs of the central web portions 5430 when the panel 5100 is assembled.

Because the steel plate 5152 that is connected to the outer portion of the cast refractory member 4150 is only of a width equal to that of the outer surface 5422, when identical cast refractory members 4150 are positioned side by side with their inner surface portions extending substantially contiguously, as is depicted in FIG. 18, steel strips or bars 5135 need to be inserted between the steel plates 5152 that are connected to the cast refractory members 4150 so that the steel plates 5152 and strips 5135 can define a steel layer that extends substantially without interruption when the plates 5152 and strips 5135 are mounted on a mounting surface of a frame (not shown), such as the mounting surface 120 of the frame 110.

To aid in mounting the cast refractory members 5150, reinforcement such as expanded metal 5153 extends into the central web portions 5430 (the cast refractory members 5150 are mold-formed about the expanded metal reinforcement 5153 when the cast refractory members are mold-formed in the manner that has been described in conjunction with the forming of the cast refractory members 150). Threaded metal rods 5155 connect with the expanded metal reinforcement 5153, extend through holes formed in the steel plates 5152, and provide threaded outer end regions that can be secured to a suitably configured frame (not shown).

Figure 19:
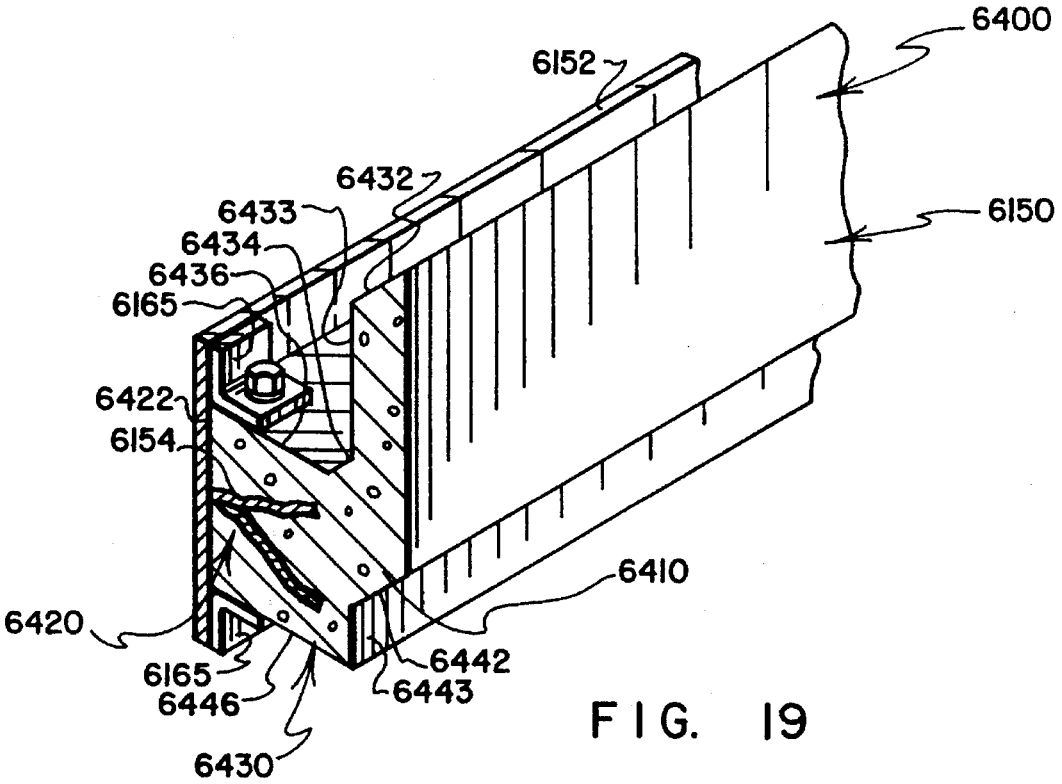
FIG. 19 is a perspective view similar to FIGS. 13, 15 and 17 but showing selected central portions of a cast refractory member that is utilized in a seventh embodiment of the invention; and, FIG. 20 is a sectional view similar to FIGS. 14, 16 and 18 but showing seventh embodiment features as utilized in an insulated panel.
Figure 20:
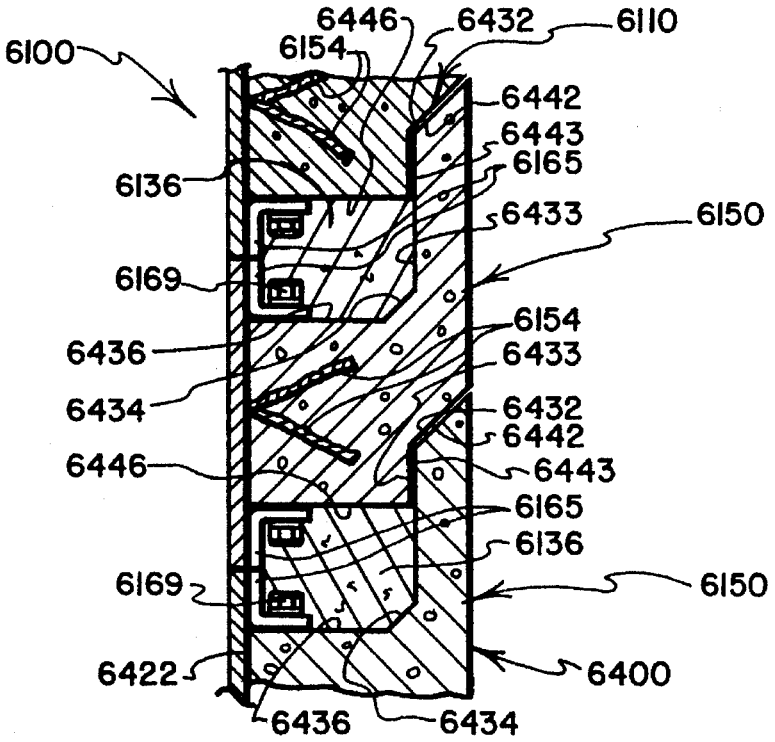

Still another cast refractory cross section is depicted in FIGS. 19 and 20 where the non-symmetrical cast refractory member 6150 is depicted as having an inner portion 6410 that defines a generally flat inner surface portion 6400, has an outer portion 6420 (that typically is about half as wide as is the inner surface portion 6400) that extends into engagement with and is connected to a steel plate 6152, and has a central web portion 6430 that maintains a relatively wide width as it extends away from the flat inner surface portion 6400 (see the parallel extending surfaces 6432, 6442). The parallel surfaces 6432, 6442 are joined by transversely extending surfaces 6433, 6443; and an inclined surface 6434 joins with the transversely extending surface 6432—whereby the central web 6430 is then defined by a pair of opposed, parallel extending surfaces 6436, 6446 that ultimately define opposite edges of an outer surface 6422 of the refractory member 6140. Fiber-type refractory members 6136 are compressively sandwiched between adjacent pairs of the central web portions 6430 when the panel 6100 is assembled.

Because the steel plate 6152 that is connected to the outer portion 6420 of the cast refractory member substantially equals the width of the inner surface portion 6400, when identical cast refractory members 6150 are positioned side by side with their inner surface portions 6400 extending substantially contiguously, as is depicted in FIG. 20, the steel plates 6152 extend side by side to define a substantially contiguously layer of steel that can be welded to a suitably configured frame (not shown) such as the frame 110 of the first panel embodiment 100 to mount the cast refractory members 6150 thereon.

What the fourth, fifth, sixth and seventh embodiments 3100, 4100, 5100 and 6100 share in common is that each of these embodiments provides a frame mountable array of the cast refractory members 3150, 4150, 5150 and 6150, and the non-cast refractory members 3136, 4136, 5136 and that have the following characteristics in common:

1) Each of the panels 3100, 4100, 5100 and 6100 employs a plurality of cast refractory members 3150, 4150, 5150 or 6150 that extend side by side in substantially parallel relationship;

2) Each of the panels 3100, 4100, 5100 and 6100 has its cast refractory members 3150, 4150, 5150 or 6150 arranged such that the inner surface portions 3400, 4400, 5400 or 6400 are arranged to extend in a common plane and substantially contiguously so as to define a rigid, impact resistant inner surface that faces toward a thermal treatment chamber for absorbing, storing and reradiating impingent heat energy back into the chamber;

3) Each of the panels 3100, 4100, 5100 and 6100 employs a plurality of cast refractory members 3150, 4150, 5150 or 6150 that have relatively thin outer portions 3420, 4420, 5420 or 6420 that are connected to steel plates 3152, 4152, 5152 or 6152 that are intended to be connected to (and to essentially become a component part of) a supporting frame;

4) Each of the panels 3100, 4100, 5100 and 6100 employs a plurality of cast refractory members 3150, 4150, 5150 or 6150 that have relatively central web portions 3430, 4430, 5430 or 6430 that provide needed strength and rigidity while, at the same time, permitting only minimal conductive heat transfer therethrough; and, 5) Each of the cast refractory members 3150, 4150, 5150 and 6150 has central web portions 3430, 4430, 5430 or 6430 that (between adjacent pairs thereof) compressively sandwich the elongate, non-cast, fiber-type thermal insulating members 3136, 4136, 5136 or 6136 for enhancing the panel's insulating capability while assisting an outer supporting frame in supporting the panel's sandwiched array of cast and non-cast insulating members, with the fiber-type insulating members 3136, 4136, 5136 and 6136 being sandwiched between webs of adjacent pairs of the cast refractory members so that fibers from the fiber-type insulating members 3136, 4136, 5136 and 6136 are confined to spaces located between the webs, and are thereby kept from entering a treatment chamber that is located inwardly with respect to the inner surface portions 3400, 4400, 5400 and 6400 of the cast refractory members 3150, 4150, 5150 and 6150.

Moreover, the cast refractory members 3150, 4150, 5150 and 6150 utilized in each of the fourth, fifth, sixth and seventh embodiments 3100, 4100, 5100 and 6100 have their cross sections "optimized" to serve different sets of needs presented by different applications. For example, the center web portions 3430 of the fourth panel embodiment 3100 that is depicted in FIGS. 13 and 14 diminishes in width to the width of the outer surface 3422 as quickly as the angle of inclination of the surfaces 3432, 3442 will permit—with the angle of inclination of the surfaces 3432, 3442 and the thickness of the outer web portion 3420 being selected to provide the cast refractory member 3100 with a degree of strength that has been determined to be needed in the application that is to be served by the panel 3100.

By way of further example, in an application served by the panel embodiment 4100 that requires more impact resistance (than is provided by the panel embodiment 3100) which is to be achieved by utilizing a greater number of cast refractory members 4150 (per unit of width than are used in the panel embodiment 3100) with each of the cast refractory members 4150 being more narrow (than are the refractory members 3150), the cast refractory members 4150 of the panel 4100 are more narrow (than are the cast refractory members 3150), but have central web portions 4130 that do not taper so as to narrow quite as quickly (as do the central webs 3130 of the refractory members 3150). However, in the panel embodiment, a narrower outer surface 4422 (than the outer surface 3422 of the panel 3100) is used that helps to narrow the path through which heat can be transferred conductively from the inner surface 4400 to the outer surface 4422—whereby appropriate balances are deemed to have been achieved between providing panel strength, rigidity and longevity of service life with the need to minimize conductive heat transfer.

By way of another example, in an application served by the panel embodiment 5100 where providing a relatively thick inner portion 5410 is deemed to be necessary to serve an application wherein a primary concern is that an inner portion be provided that can absorb, store and re-radiate impingent heat energy, a relatively thick inner portion 5410 is provided, but web thickness is cut to a minimum thereafter in order to minimize the conductive heat transfer path between the inner and outer surfaces 5400, 5422.

The extremely thin web cross section of the cast refractory members 5150 is obviously limited in the amount of force loading that it will withstand. For this reason, it will be understood that, while the other cast refractory members described and illustrated herein ordinarily can be utilized in panels that are installed in practically any orientation, panels such as the panel 5100 that utilizes refractory members such as the refractory member 5150 that have very thin central web cross sections are best suited for horizontal installations (wherein the inner surface portions 5400 extend substantially horizontally) that cause their central web portions to extend substantially vertically so that the force of gravity acts along and parallel to the lengths of their central web portions.

The cast refractory member 6150 utilized in the seventh panel embodiment 6100 shows how an inner portion 6410 can be offset with respect to an outer surface portion 6420, with a relatively thin web portion (defined between the inclined surfaces 6432, 6442) situated therebetween that minimizes the width of the conductive heat transfer path. Because adjacent ones of the members 6150 have inner portions 6410 that overlap and provide support for each other, the cast refractory members 6150 tend to provide a very strong, very impact resistant panel 6100. In many applications, width reductions can be made to narrow the width of the conductive heat transfer path that permits heat energy to travel from the inner surface 6400 to the outer surface 6422 (to thereby reduce the amount of heat energy that tends to travel from the inner surface 6400 to the outer surface 6422), for example by diminishing the width between the inclined surfaces 6434, 6442, and/or by diminishing the width between the parallel surfaces 6436, 6446.

As those who are skilled in the art will understand (taking into account the discussion presented above), "optimizing" the cross sections of cast refractory members (that are used in panels of the general type described above) calls for striking an appropriate balance between such considerations of the type that are discussed above. The inner surface portion of a cast refractory member needs to present a sufficient mass of cast refractory material to provide a capability to absorb, store and re-radiate impingent heat energy. The inner, outer and web portions of a cast refractory member need to be configured, reinforced and/or feature sufficient mass to be able to support the inner surface portion, to compressively confine adjacently sandwiched bodies of fiber-type refractory, and to enable the cast refractory member to withstand impact—and yet to offer a minimum of mass, a conductive heat transfer path of minimum width and/or an outer surface of minimum width to do what can be done to minimize conductive heat transfer from the inner surface to the outer surface of the cast refractory member.

In preferred practice, some form of steel anchor and/or reinforcement (a variety of such components have been described above) extends into outer and central web portions of each cast refractory member to facilitate the connection of each cast refractory member to its own separate steel backing sheet (and ultimately to an outer supporting frame).

While the width of the steel sheet that abuts the outer surface of a cast refractory member (to which the cast refractory member is rigidly connected) has little to do with the proper performance of a cast refractory member in an assembled panel, the width of the steel sheet preferably is selected to help provide ease of assembly—it being appreciated that some cast refractory cross sections probably are easier to assemble when forming a panel if their attached steel sheets are relatively wide so as to require no intervening steel strips (in forming a substantially contiguous layer of steel that essentially covers the mounting surface provided by a suitably configured support frame).

While the first, second and third cast refractory members 150, 1150 and 2150 have cross sectional configurations that, in large measure, fit the first four of the five important characteristics (enumerated several paragraphs above as items "1)," "2)," "3)" and "4)"), and while non-cast, fiber-type thermal insulating members are compressively sandwiched between adjacent pairs of the cast refractory members as is called for in the fifth of the five points, none of the first three cast refractory embodiments 150, 1150, 2150 are depicted in FIGS. 1–12 as meeting the positioning requirement of the second of the five points, namely that adjacent ones of the cast refractory members have their wide inner portions arranged to extend substantially contiguously to define a substantially uninterrupted inner surface for absorbing, storing and re-radiating impingent heat energy back into the chamber; however, as has been pointed out above, the cast refractory members 2150 have cross sections that should permit these members to be positioned adjacent each other to meet this requirement. Also, unless the cast refractory members 150, 1150 or 2150 are positioned substantially adjacent each other, the resulting panel will fail to achieve preferred practice because its fiber-type refractory members will not be prevented from discharging loose fibers into the treatment chamber through spaces located between the inner portions of the cast refractory members 150, 1150, 2150.

While the preferred practice of the present invention has been described and illustrated herein as being applied to insulated panels 1) that are of substantially rectangular shape, 2) that are designed to extend substantially vertically when cooperating with other structure to assist in minimizing heat loss from a treatment chamber, and 3) that typically are utilized as "closures" to provide access through hearth openings to treatment chambers of steel reheat furnaces, those who are skilled in the art readily will understand that principles of the present invention can be utilized a) to provide insulated panels of a wide variety of configurations other than rectangular, b) to provide insulated panels that extend in other than vertical orientations, and c) to provide insulated panels that cooperate with structure other than the walls of a steel reheat furnace. By way of but one example, principles of the present invention can be utilized to form circular insulated panels that can be deployed substantially horizontally to overlie and cooperate with the rims of ladles to provide ladle covers that assist in retaining heat energy within the ladles.

Although the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. An insulated wall panel for cooperating with other wall structure as extends peripherally about portions of a treatment chamber of a high temperature furnace to assist in minimizing the loss of heat energy from the treatment chamber and to absorb, store and re-radiate impingent heat energy from the periphery of the treatment chamber back toward central regions of the treatment chamber, comprising:

a) frame means for defining a rigid support structure that is positionable to extend along selected portions of the periphery of a treatment chamber of a high temperature furnace;

b) insulation means for being connected to the frame means, and for defining an inner surface that faces toward the treatment chamber and an outer surface that faces toward the frame means when the frame means is positioned to extend along a portion of the periphery of the treatment chamber, wherein the insulation means includes a sandwiched array of two types of insulating members, namely:

1) a plurality of rigid, elongate cast refractory members that are arranged in a side by side array, with each of the cast refractory members having: A) outer portion means for defining at least a part of said outer surface; B) inner portion means for extending in closely spaced relationship with the inner portion means of adjacent elongate cast refractory members to provide a continuum of cast refractory material for defining said inner surface and for providing the wall panel with a capability, when exposed directly to the environment of the treatment chamber, for absorbing and storing impingent heat energy from the treatment chamber, and for re-radiating heat energy back into the treatment chamber; and C) central web portion means for structurally connecting the inner portion means of each cast refractory member with the outer portion means thereof;

2) a plurality of compressible fiber-type refractory insulation members, with at least a separate one of the fiber-type insulation members being compressively sandwiched between the central web portion means of adjacent pairs of the cast refractory members for substantially filling space as exists between the central web portion means of adjacent pairs of the cast refractory members;

c) wherein the elongate cast refractory members, when viewed in cross sections taken transversely with respect to the lengths of the cast refractory members, show said inner portion means 1) to be relatively wide in comparison to the widths of the central web portion means so that the closely spaced relationship that exists between the inner portion means of adjacent pairs of the cast refractory members functions to confine the fiber-type insulation members so that fibers therefrom are restrained from escaping from between adjacent pairs of the inner portion means into the treatment chamber, and 2) to shield the fiber-type insulation members from direct exposure to the best environment of the treatment chamber; and, d) connection means is provided for connecting the insulation means to the frame means.

2. The insulated wall panel of claim 1 wherein the elongate cast refractory members are formed to have a substantially constant, substantially identical cross section along their lengths, and the elongate cast refractory members are arranged to extend substantially parallel to each other in defining said side by side array.

3. The insulated wall panel of claim 2 wherein the connection means connects the cast refractory members to the frame means in a manner that causes substantially all portions of the inner surface of the wall panel to extend within a common plane.

4. The insulated wall panel of claim 3 wherein:

a) the connection means includes a plurality of steel plates;

b) each of the steel plates 1) is rigidly connected to a separate associated one of the cast refractory members, and 2) extends closely along the outer surface portion that is defined by its associated cast refractory member; and, c) each of the steel plates is rigidly connected to the frame means.

5. The insulated wall panel of claim 4 wherein the steel plates and its associated cast refractory member are rigidly connected, at least in part, by anchor means that is connected to the steel plate and that is at least partially embedded within the cast refractory material that forms the associated cast refractory member.

6. The insulated wall panel of claim 5 wherein the anchor means extends within the cast refractory material of the associated cast refractory member in a manner that serves to strengthen and reinforce the associated cast refractory member within the vicinity of the location where the anchor means extends within the cast refractory material.

7. The insulated wall panel of claim 4 wherein the steel plates and the frame means are rigidly connected, at least in part, by welds that rigidly connect portions of at least one of the steel plates to the frame means.

8. The insulated wall panel of claim 4 wherein the steel plates and the frame means are rigidly connected, at least in part, by elongate threaded means that is connected to the one steel plate and is adapted to be connected to the frame means.

9. The insulated wall panel of claim 4 wherein at least one of the steel plates and its associated cast refractory member are rigidly connected, at least in part, by elongate threaded fastener means that is connected to the one steel plate and that extends through a part of the associated cast refractory member other than through the inner portion means of the associated cast refractory member.

10. The insulated wall panel of claim 4 wherein at least one of the steel plates has a width that is substantially equal to the width of the inner surface portion that is defined by its associated cast refractory member.

11. The insulated wall panel of claim 4 wherein an adjacent pair of the cast refractory members includes first and second cast refractory members wherein each defines a portion of the inner surface that has a width that is substantially equal to the width of its associated steel plate, and wherein the associated steel plates extend in closely spaced relationship so as to cooperate with other portions of the firsthand second cast refractory members to confine the compressively sandwiched fiber-type refractory members so that fibers therefrom are restrained from escaping between the associated steel plates.

12. The insulated wall panel of claim 4 wherein an adjacent pair of the cast refractory members each has an associated steel plate that is of a width that substantially equals the width of its associated outer portion means, and flat steel means is provided for extending within a common plane that is occupied by the associated steel plates to substantially fill space as exists between the associated steel plates, whereby the associated steel plates and the flat steel means that extends between the associated steel plates cooperate to confine the compressively sandwiched fiber-type refractory members so that fibers therefrom are restrained from escaping between the associated steel plates.

13. The insulated wall panel of claim 3 wherein the side by side array of cast refractory members has adjacent pairs of the cast refractory members with their inner portion means so closely positioned that fibers from the fiber-type insulation members are effectively prevented from passing between the closely spaced inner portion means and into the treatment chamber.

14. The insulated wall panel of claim 3 wherein refractory mortar means is installed between the inner portion means of at least one adjacent pair of the cast refractory members to assist in preventing fibers from the fiber-type insulation from passing between inner portion means of the adjacent pair and into the treatment chamber.

15. The insulated wall panel of claim 3 wherein each of the cast refractory members has a part of its central web portion means defined by opposed surfaces that extend substantially parallel to each other.

16. The insulated wall panel of claim 15 wherein said part of the central web portion means is located near the outer portion means of its associated cast refractory member.

17. The insulated wall panel of claim 15 wherein said part of the central web portion means is located near the inner portion means of its associated cast refractory member.

18. The insulated wall panel of claim 3 wherein each of the cast refractory members has a part of its central web portion means defined by opposed surfaces that are oppositely inclined with respect to an imaginary center plane that substantially equidistantly bisects the angle that is defined between the opposed surfaces.

19. The insulated wall panel of claim 18 wherein said part of the central web portion means is located near the outer portion means of its associated cast refractory member.

20. The insulated wall panel of claim 19 wherein said part of the central web portion means is located near the inner portion means of its associated cast refractory member.

21. The insulated wall panel of claim 1 wherein at least one of the elongate cast refractory members is of substantially uniform cross section along its length, and the central web portion means of said one of the elongate cast refractory members has at least a part of its cross section that diminishes in width as it extends away from its inner portion means toward its outer portion means to progressively diminish the width of the conductive heat path that is provided by the central web portion means for conductively transferring heat energy from the inner surface to the outer surface of the wall panel.

22. The insulated wall panel of claim 1 wherein at least one of the elongate cast refractory members is of substantially uniform cross section along its length, and the central web portion means of said at least one of the elongate refractory members has a cross section that diminishes to a minimal width measurement at a selected point along the length of the cross section, with the minimal width measurement being selected to provide the narrowest width that is deemed necessary to provide good refractory member integrity, strength and service life, whereby the width of the conductive heat path that is provided by the central web portion means for conductively transferring heat energy from the inner surface to the outer surface of the wall panel is held to a minimum at the selected point.

23. The insulated wall panel of claim 22 wherein the inner portion means of said one of the elongate cast refractory members is bordered on opposite sides by a pair of opposed, substantially parallel surfaces that extend substantially perpendicular to the inner surface of the wall panel.

24. The insulated wall panel of claim 22 wherein the outer portion means of said one of the elongate cast refractory members is bordered on opposite sides by a pair of opposed, substantially parallel surfaces that extend substantially perpendicular to the inner surface of the wall panel.

25. The insulated wall panel of claim 22 wherein said one of the elongate cast refractory members has steel reinforcing means embedded within at least its outer portion means for strengthening at least a part of said one of the elongate cast refractory members.

26. The insulated wall panel of claim 25 wherein said steel reinforcing means extends into the central web portion means of said one of the elongate cast refractory members for strengthening at least a part of the central web portion means.

27. The insulated wall panel of claim 1 wherein at least one of the elongate cast refractory members is of substantially uniform cross section along its length, and the smallest width of the uniform cross section is located at an outermost part of the outer portion means where said outer surface portion is defined, whereby the width of the conductive heat path that is defined by said uniform cross section for conductively transferring heat energy from the inner surface to the outer surface of the wall panel is minimized at the location of said outer surface portion.

28. The insulated wall panel of claim 1 wherein two adjacent ones of the cast refractory members are characterized by a) a first cast refractory member that has a part of its central web portion means that defines a surface that faces generally toward the treatment chamber, and b) a second cast refractory member that has a part of its inner portion means that overlies said surface that faces generally toward the treatment chamber.

29. A method of forming an insulated wall panel product for cooperating with other wall structure as extends peripherally about portions of a treatment chamber of a high temperature furnace to assist in minimizing the loss of heat energy from the treatment chamber and to absorb, store and reradiate impingent heat energy from the periphery of the treatment chamber back toward central regions of the treatment chamber, comprising the steps of:

a) providing frame means for defining a rigid support structure that is positionable to extend along selected portions of the periphery of a treatment chamber of a high temperature furnace;

b) providing insulation means for being connected to the frame means, and for defining an inner surface that faces toward the treatment chamber and an outer surface that faces toward the frame means when the frame means is positioned to extend along a portion of the periphery of the treatment chamber, wherein the insulation means includes a sandwiched array of two types of insulation members, namely:

1) a plurality of rigid, elongate cast refractory members of predetermined lengths, with each of the cast refractory members having: A) outer portion means for defining at least a part of said outer surface of the wall panel; B) inner portion means for extending in closely spaced relationship with the inner portion means of adjacent elongated cast refractory members to provide a continuum of cast refractory material for defining said inner surface; C) central web portion means of predetermined width for structurally connecting the inner portion means of each cast refractory member with the outer portion means thereof; and, D) wherein the elongate cast refractory members, when viewed in cross sections taken transversely with respect to the lengths of the cast refractory members, show said inner portion means to be relatively wide in comparison to the widths of the central web portion means, and, 2) a plurality of compressible fiber-type refractory insulation members; and, c) connecting the elongate cast refractory members to the frame means:

1) with the elongate cast refractory members being arranged so as to extend side by said so that the inner portion means of adjacent elongate cast refractory members provide a continuum of cast refractory material for defining said inner surface;

2) with at least a separate one of the fiber-type insulation members being compressively sandwiched between the central web portion means of adjacent pairs of the cast refractory members for substantially filling space as exists between the central web portion means of adjacent parts of the cast refractory members;

3) with inner portion means of adjacent pairs of the elongate cast refractory members extending into sufficiently closely spaced relationship to form a substantially contiguous inner surface of the wall panel: A) that provides the wall panel with a capability, when the inner surface of the wall panel is exposed directly to the heat environment of the treatment chamber, for absorbing and storing impingent heat energy from the treatment chamber, and for re-radiating heat energy back into the treatment chamber; B) that confined the fiber-type insulation members so that fibers therefrom are restrained from escaping from between adjacent pairs of the inner portion means into the treatment chamber; and C) that shields the fiber-type insulation members from direct exposure to the heat environment of the treatment chamber.

30. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 29.

31. The method of claim 29 additionally including the steps of:

a) providing an elongate steel plate that has a width that is at least the same as is the width of the wall panel outer surface that is defined by the outer portion means of one of the elongate cast refractory members;

b) connecting said steel plate to said one of the cast refractory members so as to extend along said outer surface portion of said particular cast refractory member; and, c) mounting said one cast refractory member on said frame means with said steel plate in engagement with portions of said frame means.

32. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of

33. The method of claim 31 wherein the step of mounting said particular cast refractory member on said frame includes the step of connecting said steel plate to said frame means in locations where said steel plate engages portions of said frame means.

34. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 33.

35. The method of claim 31 wherein the step of connecting said steel plate to said particular cast refractory member includes the steps of:

a) providing a suitably configured mold for mold-forming said particular cast refractory member;

b) providing anchor means that is connected to said steel plate;

c) positioning said steel plate and said anchor means prior to mold-forming of said particular cast refractory member 1) so that the steel plate cooperates with the mold to defines an outer surface portion of said particular cast refractory means, and 2) so that the anchor means extends at least into the portion of the mold that will form said outer portion means of said particular cast refractory member; and, d) introducing a hardenable cast refractory material into the mold while the cast refractory material takes the form of a hardenable liquid, so as to cause the hardenable liquid to flow about said anchor means to cause said anchor means to be embedded in at least said outer portion means of said particular cast refractory member when the hardenable liquid hardens to form said particular cast refractory member.

36. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 35.

37. The method of claim 29 additionally including the steps of:

a) providing a plurality of elongate steel plates so that each steel plate can be associated with a separate one of the elongate cast refractory members, with each of the steel plates having a width that is at least the same as is the width of the wall panel outer surface portion of its associated cast refractory member;

b) connecting each of the steel plates to its associated cast refractory member so as to extend along the outer surface portion of its associated cast refractory member; and, c) mounting the associated cast refractory members on said frame means with their associated steel plates extending into engagement with portions of said frame means.

38. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 37.

39. The method of claim 37 wherein the step of connecting each of the steel plates to its associated cast refractory member includes the steps of:

a) providing anchor means, portions of which have been embedded within at least the outer portion means of the associated cast refractory member when the cast refractory member was formed; and b) securely connecting the anchor means to the associated steel plate.

40. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 39.

41. The method of claim 39 wherein the step of providing anchor means includes the step of providing reinforcement means connected to the anchor means for extending within a predetermined region of the associated cast refractory member when the cast refractory member was formed, whereby the presence of the reinforcement means will serve to strengthen portions of the associated cast refractory member located within the vicinity of said predetermined region.

42. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 41.

43. The method of claim 41 wherein the step of providing a plurality of elongate steel plates includes the step of providing each steel plate with a width that substantially equals the portion of inner surface width that the inner portion means of its associated cast refractory member defines once the cast refractory members have been positioned in said side by side array.

44. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 43.

45. A method of forming a heat-insulating product for lining a panel frame that is to be positioned about the periphery of a high temperature treatment chamber, comprising the steps of:

a) providing a plurality of rigid elongate cast refractory members of predetermined lengths, with each of the cast refractory members having: 1) outer portion means for defining at least a part of said outer surface of the wall panel; 2) inner portion means for extending in closely spaced relationship with the inner portion means of adjacent elongate cast refractory members to provide a continuum of cast refractory material for defining an inner surface; 3) central web portion means of predetermined width for structurally connecting the inner portion means of each cast refractory member with the outer portion means thereof; and, 4) wherein the elongate cast refractory members, when viewed in cross sections taken transversely with respect to the lengths of the cast refractory members, show said inner portion means to be relatively wide in comparison to the widths of the central web portion means; and, b) mounting the plurality of elongate cast refractory members on a frame as by establishing secure connections between at least the outer portion means of the cast refractory members and the frame so that resulting elongate assemblies of the cast refractory members and the frame extend in spaced, substantially parallel, side by side array with pocket-like spaces being defined between adjacent ones of the cast refractory members;

c) installing elongate compressible fiber-type refractory insulating members so that, when the formation of the heat-insulating product is complete, at least a separate one of the fiber-type insulating members is compressively sandwiched within each of the pocket-like spaces between adjacent ones of the cast refractory members' and, d) with the steps of mounting the cast refractory members and of installing the fiber-type refractory insulating members being carried out such that, when the formation of the heat-insulating product is complete, the inner portion means of adjacent pairs of the elongate cast refractory members extends into sufficiently closely spaced relationship to form a substantially contiguous inner surface of the wall panel: 1) that provides the wall panel with a capability, when the inner surface of the wall panel is exposed directly to the heat environment of the treatment chamber, for absorbing and storing impingent heat energy from the treatment chamber, and for re-radiating such heat energy back into the treatment chamber; 2) that confines the fiber-type insulation members so that fibers therefrom are restrained from escaping from between adjacent pairs of the inner portion means into the treatment chamber; and 3) that shields the fiber-type insulation members from direct exposure to the heat environment of the treatment chamber.

46. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 45.

47. The method of claim 45 wherein:

a) the step of providing a plurality of elongate cast refractory members includes the steps of:

1) providing a plurality of elongate steel plates for respective association with a separate one of the elongate cast refractory members, with each of the steel plates having a width that is at least the same as the width of the outer surface portion of its associated cast refractory member;

2) connecting each of the steel plates to its associated cast refractory member so as to extend along the outer surface portion of its associated cast refractory member; and, b) the step of mounting the elongate cast refractory members on the frame includes the step of rigidly connecting the steel plates to portions of the frame.

48. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 47.

49. The method of claim 47 wherein the step of connecting each of the steel plates to its associated cast refractory member includes the steps of:

a) providing anchor means, portions of which have been embedded within at least the outer portion means of the associated cast refractory member when the cast refractory member was formed; and, b) securely connecting the anchor means to the associated steel plate.

50. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 49.

51. The method of claim 49 wherein the step of providing anchor means includes the step of providing reinforcement means connected to the anchor means for extending within a predetermined region of the associated cast refractory member when the cast refractory member was formed, whereby the presence of the reinforcement means will serve to strengthen portions of the associated cast refractory member located within the vicinity of said predetermined region.

52. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 51.

53. The method of claim 51 wherein the step of providing a plurality of elongate steel plates includes the step of providing each steel plate with a width that substantially equals the portion of inner surface width that the inner portion means of its associated cast refractory member defines once the cast refractory members have been positioned in said side by side array.

54. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 53.

55. The method of claim 45 wherein the step of mounting the cast refractory members is carried out such that adjacent pairs of the cast refractory members are mounted with their inner portion means positioned so closely together that fibers from the fiber-type insulation members are effectively prevented from passing between the closely spaced inner portion means and into the treatment chamber.

56. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 55.

57. The method of claim 45 wherein the step of mounting the cast refractory members includes the step of installing refractory mortar between the inner portion means of at least one adjacent pair of the cast refractory members to assist in preventing fibers from the fiber-type insulation from passing between inner portion means of the adjacent pair and into the treatment chamber.

58. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 57.

59. The method of claim 45 wherein the step of providing cast refractory members includes the step of forming the cast refractory members wherein the cross section of each of the cast refractory members diminishes to a minimal width measurement at a selected point along the length of the cross section, with the minimal width measurement being selected to provide the narrowest width that is deemed necessary to provide good refractory member integrity, strength and service life, whereby the width of the conductive heat path that is provided by the central web portion means for conductively transferring heat energy from the inner surface to the outer surface of the wall panel is held to a minimum at the selected point.

60. An insulated wall panel product having fiber-type insulation members compressively sandwiched between adjacent elongate cast refractory members fully filling space therebetween and with said refractory members forming a continuous surface on one side of said wall panel product to shield said compressively sandwiched insulation members from direct exposure to a high heat environment on said one side of said wall panel product formed in accordance with the method of claim 59.

* * * * *